US007571060B2

(12) United States Patent
Blodgett et al.

(10) Patent No.: US 7,571,060 B2
(45) Date of Patent: Aug. 4, 2009

(54) SYSTEM AND METHOD FOR GEMSTONE CUT GRADING

(75) Inventors: Troy Blodgett, Flagstaff, AZ (US); Ronald Geurts, Antwerp (BE); Al Gilbertson, Murrieta, CA (US); Barak Green, Oceanside, CA (US); T. Scott Hemphill, Lexington, MA (US); Tom Moses, Princeton Junction, NJ (US)

(73) Assignee: Gemological Institute of America (GIA), Carlsbad, CA (US)

( * ) Notice: Subject to any disclaimer, the term of this patent is extended or adjusted under 35 U.S.C. 154(b) by 540 days.

(21) Appl. No.: 10/952,386

(22) Filed: Sep. 27, 2004

(65) Prior Publication Data

US 2006/0074588 A1 Apr. 6, 2006

(51) Int. Cl.
*G01B 5/28* (2006.01)
*G06F 17/18* (2006.01)

(52) U.S. Cl. ..... 702/35; 356/30; 451/28; 451/41; 702/179

(58) Field of Classification Search ..... 702/35, 702/166, 170, 179; 356/30; 451/28, 41; 705/27

See application file for complete search history.

(56) References Cited

U.S. PATENT DOCUMENTS 5,816,896 A 10/1998 Schouwenaars
5,966,673 A 10/1999 Shannon, Sr.
6,020,954 A 2/2000 Aggarwal
6,304,853 B1 10/2001 Malnekoff
6,786,733 B2 9/2004 Lapa et al.
6,980,283 B1 * 12/2005 Aggarwal ..... 356/30
2002/0052170 A1 5/2002 Holloway
2004/0051861 A1 3/2004 Bray
2004/0246464 A1 12/2004 Sivovolenko
2005/0190356 A1 9/2005 Sasian et al.
2005/0190357 A1 9/2005 Sasian et al.
2005/0200834 A1 9/2005 Sasian et al.

OTHER PUBLICATIONS

R.M. Shipley, Assignment 2-30: "The Critical Angle and Comparative Brilliancy," Diamonds Course, Gemological Institute of America (1948, date approximate), p. 1, Los Angeles.
L. J. Cronbach, "Coefficient Alpha and the Internal Structure of the Tests," Psychometrika (1951), pp. 297-334, vol. 16.

(Continued)

*Primary Examiner*—John H Le
(74) *Attorney, Agent, or Firm*—DLA Piper LLP (US)

(57) ABSTRACT

A system for grading the cut of a diamond utilizes a number of appearance metrics to generate scores for a number of cut components that affect cut quality. These cut components include brightness, fire, scintillation, overweight, durability, polish, and symmetry. The cut grading system employs a cut grading algorithm that processes the individual scores obtained for the cut components to generate an overall cut grade for the diamond. The scoring methodology and the cut grading algorithm are designed to emulate actual observation grading such that the overall cut grade represents a fair indication of the cut quality of the diamond. In one practical embodiment, the cut grading system is fully automated and computer-implemented.

14 Claims, 10 Drawing Sheets

OTHER PUBLICATIONS

E. Fey, "Unpublished research completed for GIA," (1975).
"Computer Used to Set Standard of Gem Beauty," Retail Jeweler (Jan. 19, 1978), p. 40.
J.S. Dodson, "A Statistical Assessment of Brilliance and Fire for Polished Gem Diamond on the Basis of Geometrical Optics," Optica Acta (1978), pp. 681-692, vol. 25, No. 8.
J.S. Dodson, "The Statistical Brilliance, Sparkliness, and Fire of the Round Brilliant-Cut Diamond," Diamond Research (1979), pp. 13-17.
A. Hardy, et al., "Ray Tracing Study Of Gem Quality," Optica Acta (1981), pp. 801-809, vol. 28, No. 6.
G. Keren "Statistical and Methodological Issues in Psychology and Social Sciences Research," L. Erlbaum Associates (1982), 390 pp. 14-19, Hillsdale, New Jersey.
G. Lenzen, "Diamonds and Diamond Grading," Butterworths (1983), p. 164, London.
P.G. Van Zanten, "Finding Angles For Optimal Brilliance By Calculation," Seattle Faceter Design Notes, Nov. 1987.
R. Long, et al., Facet Design Rounds, vol. 5, Seattle Faceting Books (1984) (56 pgs.).
C. Tognoni, "An Automatic Procedure For Computing The Optimum Cut Proportions Of Gems," La Gemmologia (1990), pp. 23-32, vol. 25, No. 3-4.
D.V. Manson, "Proportion Considerations In Round Brilliant Diamonds," In A. S. Keller, Ed., Proceedings of the International Gemological Symposium (1991), Gemological Institute of America, p. 60, Santa Monica, CA.
The GIA Diamond Dictionary, 3rd ed. (1993), Gemological Institute of America, pp. 28, 72, 89, 200.
Robert W. Strickland, "GemCad for Windows Version 1.0 User's Guide" (Sep. 17, 2002) pp. 1-57.
J.C Nunnally, Psychometric Theory, 3rd ed. McGraw-Hill (1994), 752, pp. 263-266, New York.
H.O. Kiess, "Statistical Concepts for the Behavioral Sciences," Allyn and Bacon (1996), 604, pp. 436-443, Boston.
T.M., Moses, et al., "A Contribution To Understanding The Effect Of Blue Fluorescence On The Appearance Of Diamonds," Gems & Gemology (1997), pp. 244-259, vol. 33, No. 4.
G.T. Shigetomi, "Diamond Industry Breakthrough," Bangkok Gems & Jewellery (1997), pp. 97-98, 100, vol. 10, No. 8.
C.H. Yu, "Using Sas For Item Analysis And Test Construction," (1998), http://seamonkey.ed.asu.edu/~alex/teaching/assessment/alpha.html [date accessed Sep. 29, 2004].
T.S. Hemphill, et al., "Modeling The Appearance Of The Round Brilliant Cut Diamond: An Analysis Of Brilliance," Gems & Gemology (1998), pp. 158-183, vol. 34, No. 3.
K. Inoue, "Quantification And Visualization Of Diamond Brilliancy," Journal of the Gemmological Society of Japan (1999), pp. 153-167, vol. 20, No. 1-4.
P. Shannon, et al., "The Great Cut Debate Rages On." Rapaport Diamond Report (1999), pp. 89, 91, 95, vol. 22, No. 5.
Sivovolenko et al., "Diamond Cut Study (1999)" http://www.gemology.ru/cut/english/__doc4__.htm, http://www.gemology.ru/cut/english/__doc41__.htm, http://www.gemology.ru/cut/english/__doc__42.htm, http://www.gemology.ru/cut/english/__doc__43.htm, http://www.gemology.ru/cut/english/__doc__44.htm, http://www.gemology.ru/cut/english/__doc45__.htm, http://www.gemology.ru/cut/english/__mod.htm, http://www.gemology.ru/cut/english/__mod1.htm, http://www.gemology.ru/cut/english/__collect.htm (11 pgs.) [date accessed: Oct. 7, 2004].
I.M. Reinitz, et al., "Modeling The Appearance Of The Round Brilliant Cut Diamond: An Analysis Of Fire, And More About Brilliance," Gems & Gemology (2001), pp. 174-197, vol. 37, No. 3.
C.H. Yu, "An Introduction To Computing And Interpreting Cronbach Coefficient Alpha In SAS," In Proceedings of the 26th SAS Users Group International, Apr. 22-25, 2001.
M. Cowing, et al., "Hypothesis or Practicality: The Quest For The Ideal Cut," New York Diamonds (Jul. 2002), pp. 40, 42, 44, vol. 71.
B. Astric, et al., "Theoretical Study of the Aspect of a Brilliant Cut Diamond as a Function of its Cutting Parameters," Revue de Gemmologie A.F.G (1991), pp. 17-23.
L.M. Ohr, "Formulating with Sense," Prepared Foods (Feb. 2001); http://www.preparefoods.com/CDA/ArticleInformation/features/BNP__Features__Item/0,1231,114431,00.html [date accessed: Sep. 30, 2004].
N. Stern, "Computer Ray Tracing in Faceted Gemstones," Master of Science Thesis, The Weizmann Institute of Science (1975).
H. Lawless, et al., "FS410: Sensory evaluation of food," Cornell University (Fall 2003), http://zingerone.foodsci.cornell.edu/fs410 [date accessed: Sep. 30, 2004].
D.M. Lane, "Pearson's Correlation (1 of 3)," Hyperstat Online (2003), http://davidmlane.com/hyperstat/A34739.html [date accessed Sep. 29, 2004].
G. Holloway, "The Ideal-Scope," Precious Metals (2004), http://www.preciousmetals.com.au/ideal-scope.asp [date accessed: Sep. 29, 2004].
ScienceWeek article, "On the History of Crystal Engineering," http://scienceweek.com/2004/rmps-40.htm [date accessed: Jan. 24, 2006].
G. Holloway, "Diamond Cut Analysis Online—Holloway Cut Adviser," Pricescope, http://www.pricescope.com/cutadviser.asp [dated accessed May 25, 2006].
G. Holloway, "Precious Metals, Ideal Cut Diamonds and Expertly Crafted Diamond Jewellery," Precious Metals, http://www.preciousmetals.com.au/default.asp [date accessed May 25, 2006].
OctoNus, "Appraising Diamonds Quality and Pricing Diamonds" http://web.archive.org/web/20011123024319/http://www.gemology.ru/octonus/english/diamcalc/appr__price.htm [date accessed Jul. 7, 2004].
OctoNus Software Ltd. http://web.archive.org/web/20001010201649/www.gemology.ru/octonus/english/index.htm [date accessed Jul. 7, 2004].
OctoNus, "What is a DiamCalc?", http://web.archive.org/web/20001003034151/www.gemology.ru/octonus/english/diamcalc/index.htm [date accessed Jul. 7, 2004].
Russian Gemological Server, http://web.archive.org/web/20000620173618/http://www.gemology.ru/index.html [date accessed Jul. 7, 2004].
OctoNus, "What is a DiamCalc?" http://web.archive.org/web/20000604170821/www.gemology.ru/octonus/english/diamcalc/index.htm [date accessed Jul. 7, 2004].
"D. Atlas & Co., Inc./AGA-Cert Diamonds," Accredited Gem Appraisers. http://web.archive.org/web/19990125095547/http://www.gemappraisers.com/ [date accessed Jul. 7, 2004].
AGA Round Brilliants, "Round Brilliants," http://web.archive.org/web/19991010021816/gemappraisers.com/chrt1.htm [date accessed Jul. 7, 2004].
M. Thompson, et al., "Software Plots Diamonds, Helps Identify Gems," Jewelers' Circular-Keystone (1994).
T. Scott Hemphill, et al., Modeling the Appearance of the Round Brilliant Cut Diamond: An Analysis of Brilliance, Gems & Gemology, Fall 1998, p. 158-183.
Ilene M. Reinitz, et al., Modeling the Appearance of the Round Brilliant Cut Diamond: An Analysis of Fire, and More About Brilliance, Gems & Gemology, Fall 2001, p. 174-197.
Barak Green, GIA Studies Diamond Cut, Rapaport Diamond Report, vol. 26, No. 20, May 30, 2003, p. 1, 19, 21, 23.
Ivan Solotaroff, A New Diamond Age, Modern Jeweler, Oct. 2003, pp. 48-50, 52, 54, and 56.
Barbara Moss, Last Work, Seeing, Believing., Modern Jeweler, Oct. 2003, p. 96.
Stephane Guy, et al., Graphics Gems Revisited: Fast and Physically-Based Rendering of Gemstones, ACM Transactions on Graphics (TOG), vol. 23, Issue 3, Aug. 2004, p. 231-238.
Internet printout: http://www.diamond-cut.com.au/index.html, printed on Apr. 19, 2004.
International Search Report for PCT/US05/34530, mailed Oct. 4, 2007.

* cited by examiner

SYSTEM AND METHOD FOR GEMSTONE CUT GRADING

FIELD OF THE INVENTION

The present invention relates generally to the grading of gemstones. More particularly, the present invention relates to a system and method for grading the cut of diamonds.

BACKGROUND OF THE INVENTION

The quality of a diamond is often mentioned in connection with its cut, color, clarity, and carat weight (the four C's). Of the Four C's (color, clarity, cut, and carat weight), cut is the least understood—and least agreed upon—aspect of diamond appearance. Current claims about the superiority of certain round brilliant diamond cuts focus mostly on three approaches:

(1) The use of specific sets of proportions (e.g., those for the AGS 0, the AGA 1A, "Class 1" cuts [as previously taught by GIA Education], the HRD "Very Good" grades, "Ideal" cuts, and "Tolkowsky" cuts);

(2) The use of viewing devices to see specific patterns or pattern elements in diamonds (e.g., FireScope™, Symmetriscope™, IdealScope, and various "Hearts-and-Arrows"—style viewers); and (3) The use of proprietary measuring devices such as the GemEx BrillianceScope™ and ISEE2™, which measure one or more of the following aspects of diamond appearance: brilliance, fire, scintillation, and/or symmetry.

The inventors desired to begin their research on the evaluation of diamond cut with a different approach, based on the following questions: What makes a round brilliant cut (RBC) diamond look the way it does? To what degree do differences among cutting proportions create observable distinctions? Which proportion sets produce results that are deemed attractive by most experienced observers?

Early research utilizing advanced computer modeling were described briefly by Manson (1991), and then in detail by Hemphill et al. (1998) and Reinitz et al. (2001). Many other groups have used some form of computer modeling to predict appearance aspects of diamond proportion sets, including: Fey (1975), Dodson (1978, 1979), Hardy et al. (1981), Harding (1986), van Zanten (1987), Long and Steele (1988, 1999), Tognoni (1990), Strickland (1993), Shigetomi (1997), Shannon and Wilson (1999), Inoue (1999), and Sivovolenko et al. (1999). Details relating to this early work are found in the articles that are fully cited in the References section below and hereby incorporated by reference. As understood, few if any of these other studies validated their modeling results by using observation tests of actual diamonds, as is desired to do in research associated with the present invention. The validation of computer modeling by observations is deemed advantageous in the evaluation of diamond cut appearance, as without this validation there is a risk of producing results that are not applicable to the real-world assessment of diamonds.

The face-up appearance of a polished diamond is often described in terms of its brilliance (or brilliancy), fire, and scintillation (see, e.g., GIA Diamond Dictionary, 1993). Historically, however, diamond appearance has been described using other terms as well; even the addition of scintillation to this list has been a relatively recent development.

Today, while brilliance, fire, and scintillation are widely used to describe diamond appearance, the definitions of these terms found in the gemological literature vary, and there is no single generally accepted method for evaluating and/or comparing these properties in diamonds. Further, experienced members of the diamond trade use additional terms when they assess the appearance of diamonds, e.g., at various international diamond cutting centers and at trade shows, or generally by retailers and jewelry consumers. In addition to brilliance, fire, and scintillation, other words are often used such as "life", "pop", "lively", "dull", "bright", or "dead" to describe a diamond's cut appearance. These members of the diamond trade would not generally be able to explain precisely what they mean when using such terms. In some cases, they may know whether or not they like a diamond, but may be unable to articulate exactly why.

Several existing general approaches to the question of how to fashion diamonds having the best appearance may be considered. One can start with observation comparisons such as, "diamond A looks better than diamond B". However, without a predictive framework as to why one diamond looks better than another, such results are difficult to generalize.

Of course, tradition is another way to discover the best-looking diamond cuts: relying on historical work. However, traditional determinations of good-looking diamonds were based on that which was known at the time the historical diamond cutting styles were developed. New cutting technology makes different cuts practical, and new diamond sources yield rough with different shapes and colors. In these ways the economics and possibilities of cutting styles have changed. Unstated assumptions, such as the lower girdle facet lengths or the lighting environment in which a diamond is worn, are especially likely to change the observed quality. Thus, traditional solutions may not be the best solutions.

Another way to design or evaluate diamond cuts is to create models. Mathematical models employ optics theories to simulate how light interacts with a diamond. The properties of diamond as a material are quite well known, and calculations of the path light takes through transparent materials are not difficult, especially if computers are used to perform the necessary calculations. Prior to the widespread availability of computers, geometrical and graphical techniques were used. More recently, researchers have used computer modeling (usually ray tracing) to calculate light paths. Thus, diamond cuts and their optical properties can be modeled, to optimize a specific result, before any rough is cut. However, all models are based on assumptions, and the desired computer outcomes should be carefully defined mathematically before they can be calculated.

Predictions enable models (physical and virtual) to be checked for applicability. Predictive models can also be made physically: for instance, one can build an artificial environment for viewing diamonds. In this regard, a physically modeled viewing environment and a mathematically modeled viewing environment can be constructed and compared for agreement with one another. For any such model environment, an important question is relevance: what type of viewing environment is being modeled, and more importantly, how does the viewing environment relate to the actual environments in which the diamond will be viewed on a day-to-day basis?

Although viewing devices create a model for reality, they do not lend themselves easily to predictions. Instead, they allow qualitative methods for assessing the appearance of a diamond. Both systemization of the method and comparisons with observations made in more natural environments are needed in order to validate such devices.

Another option is the measurement of appearance aspects. For example, existing devices and systems may be used for measuring the brilliance and scintillation of a diamond. Such devices and systems tend to measure such characteristics according to some arbitrary scale, e.g., low, medium, high, and very high.

Some existing cut systems try to codify the best-looking diamonds using narrow ranges of individual proportions or ranges of combinations of a few proportions. Commonly, these systems distinguish a specific set of proportion ranges as best. In some respects, this amounts to a "bull's eye" approach: the proportion target is defined and all other proportion combinations are considered worse—progressively worse as the differential between the proportions and the target increases. This approach has a few dangers. First, these systems usually do not specify proportions for all the facets, especially for the stars, upper girdle, and lower girdle facets, which cover about 50% of a diamond's surface. Another concern is that proportions in such systems are usually specified individually, but not all combinations of acceptable proportions may lead to the same appearance or performance. Finally, there may be good looking (and well-performing) diamonds, having different proportions than the target, that can't be distinguished from bad-looking, poor-performing diamonds that are equally far away from the target. Thus, a bull's eye approach to proportions that finds some good-looking diamonds may not find them all.

Although a diamond's performance is quantifiable, "beauty" remains highly subjective. Appearance metrics are not subjective, but individual taste is. A cut system cannot guarantee that everyone prefers one set of proportions over another for all cases. Instead, as the cut grade worsens, the diamonds in each grade category change from those that everyone likes, to those that some people like, to those that nobody prefers. Indeed, research and trade interaction confirm that diamonds within a "top" grade category will be considered differently by different individuals. A grading system that fails to acknowledge differences in taste is neither scientific nor useful to the diamond trade.

BRIEF SUMMARY OF THE INVENTION

A gemstone cut grading system according to the invention is suitable for use with round brilliant cut diamonds. The system leverages computer modeling techniques, observation testing, and trade interaction to provide a comprehensive methodology for assessing the appearance and cut quality of diamonds. The cut grading system considers a number of cut components that affect the overall cut quality of diamonds. For a given set of cut proportions, the system generates scores for the different cut components and processes the scores to arrive at an overall cut grade. The cut component scores are derived from different calculations or determinations, some of which are designed to accurately predict observable appearance qualities. In one example embodiment, the cut grading system is computer implemented.

The above and other aspects of the present invention may be carried out in one form by a method for grading the cut of a gemstone. The method obtains a number of scores for a plurality of cut components corresponding to a gemstone representation, where each of the cut components affects cut quality for the gemstone representation, and processes the scores with a cut grading algorithm to generate an overall cut grade for the gemstone representation. The gemstone representation may correspond to an actual cut gemstone, e.g., a diamond, or a proposed or simulated gemstone. The scores include at least one appearance-related score, at least one design-related score, and at least one craftsmanship-related score.

BRIEF DESCRIPTION OF THE DRAWINGS

A more complete understanding of the present invention may be derived by referring to the detailed description and claims when considered in conjunction with the following Figures, wherein like reference numbers refer to similar elements throughout the Figures.

DETAILED DESCRIPTION OF A PREFERRED EMBODIMENT

Figure 1:
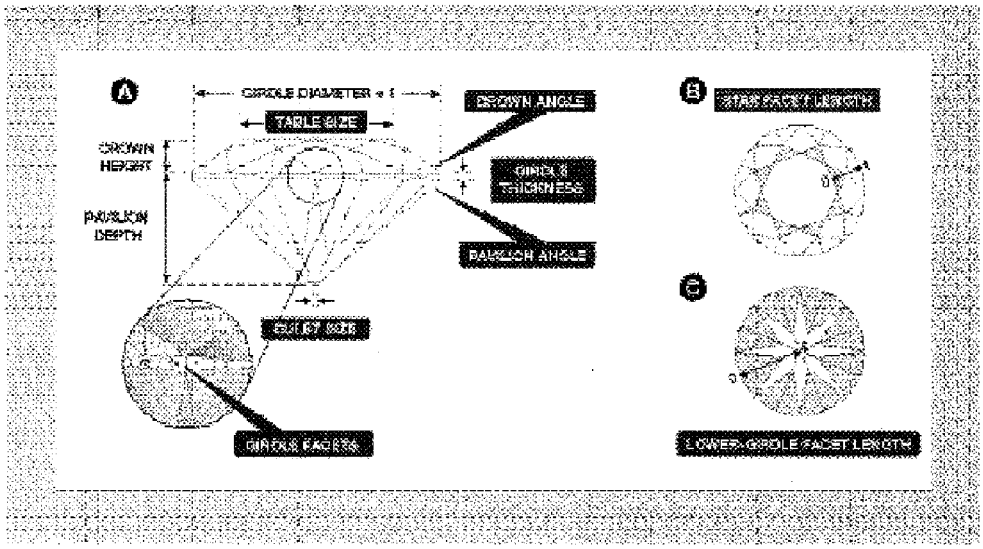
FIG. 1 illustrates several proportion parameters.

What follows is a discussion of the preferred aspects of a well-cut diamond. Testing of previously published metrics are described (numerical values based on mathematical models) for brilliance and fire by conducting observations with actual diamonds in typical trade environments. New metrics are then developed and described based on the results. It is also explained how the new metrics are validated with further observation tests. Additional methods, including environments and procedures, are developed and tested for evaluating other preferred aspects of diamond appearance and cut quality. Finally, on the basis of the information gathered during this extensive testing, a comprehensive system for assessing the cut appearance and quality of round brilliant cut diamonds is constructed. The following description sets forth a preferred framework of this system.

The present invention may be described herein in terms of functional block components and various processing steps. It should be appreciated that such functional blocks may be realized by any number of hardware, software, and/or firmware components configured to perform the specified functions. For example, the present invention may employ various integrated circuit components, e.g., memory elements, digital signal processing elements, logic elements, look-up tables, and the like, which may carry out a variety of functions under the control of one or more microprocessors or other control devices. In addition, those skilled in the art will appreciate that the present invention may be practiced in conjunction with one or more computer devices, architectures, or networks, and that the system described herein is merely one exemplary application for the invention.

It should be appreciated that the particular implementations shown and described herein are illustrative of the invention and its best mode and are not intended to otherwise limit the scope of the invention in any way. Indeed, for the sake of brevity, conventional techniques for data processing, data transmission, ray tracing, optical modeling, and other functional aspects of the systems (and the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in a practical embodiment.

The following definitions related to diamond appearance and cut grading are used herein:

"Brightness": the appearance, or extent, of internal and external reflections of "white" light seen in a polished diamond when viewed face-up. Note that although brilliance has been used to describe this property (see, e.g., Hemphill et al., 1998; Reinitz et al., 2001), it was discovered in research associated with the present invention that many individuals in the trade and general public include other appearance aspects (such as contrast) in their use of that term.

"Brightness team": the team of individuals used during observation testing to validate the brightness metric.

"Common viewing environment" (CVE): in what follows, a neutral gray box with a combination of daylight-equivalent fluorescent bulbs and overhead white LEDs (light-emitting diodes) were used to view the overall cut appearance and quality of diamonds.

"Computer model": a computer program that re-creates the properties and characteristics of an object, along with the key factors in its interaction with specified aspects of its environment.

"Craftsmanship": a description of the care that went into the crafting of a polished diamond, as seen in the finish (polish and symmetry) of a diamond.

"Cut components": a characteristic, quality, or property of a gemstone that can affect the overall cut grade of the gemstone. For example, brightness, fire, and pattern are each considered a cut component.

"Cut proportions": a linear, angular, or relative measurement of one or more physical aspects of a gemstone.

"Design": a description of a diamond's physical shape, as seen in a diamond's proportions, weight ratio, and durability.

"Durability": a description of a polished diamond that accounts for the risk of damage inherent in its proportions (i.e., the risk of chipping in a diamond with an extremely thin girdle).

"Face-up appearance": the sum appearance (brightness, fire, and scintillation) of a polished diamond when it is viewed in the table-up position. This appearance includes what is seen when the diamond is "rocked" or "tilted."

"Fire": the appearance, or extent, of light dispersed into spectral colors seen in a polished diamond when viewed face-up.

"Fire team": the team of individuals used during observation testing to validate the fire metric.

"Gemstone representation": an actual "real world" or physical gemstone, or a computerized or virtual gemstone that is characterized by appearance, proportion, or other data.

"Metric": a calculated numerical result obtained through computer modeling; in diamond cut research associated with the present invention, metrics were calculated for brightness and fire for both virtual and actual diamonds.

"Overall cut appearance and quality": a description of a polished diamond that includes the face-up appearance, design, and craftsmanship of that diamond.

"Overall observation team": the team of six individuals (who combined had over 100 years of diamond experience) used during observation testing to discover additional aspects related to face-up appearance, as well as to validate the predictions of the cut grading system in accordance with the preferred embodiment.

"Overall verification diamonds": diamonds used in this study to validate the predictive accuracy of the diamond cut grading system in accordance with the preferred embodiment. Each of these diamonds was observed for its overall cut appearance and quality by the members of the Overall observation team.

"Overweight": a descriptor for a gemstone whose proportions are such that, when viewed face-up, the gemstone appears much smaller in diameter that its carat weight would indicate.

"Polish": smoothness or shininess of surface.

"Research (reference) Diamonds" (RD): the core set of 45 polished diamonds (comprising a wide range of proportion combinations) that were purchased and/or manufactured to be used as the main sample group during the course of the research associated with the present invention.

"Scintillation": the appearance, or extent, of spots of light seen in a polished diamond when viewed face-up that flash as the diamond, observer, or light source moves (sparkle); and the relative size, arrangement, and contrast of bright and dark areas that result from internal and external reflections seen in a polished diamond when viewed face-up while that diamond is still or moving (pattern).

"Symmetry": correspondence in size, shape, and relative position of parts on opposite sides of a dividing line or median plane or about a center or axis.

"Weight ratio": a description of a diamond's overall weight in relation to its diameter.

Note that the definitions for fire and scintillation differ from those currently found for similar terms in the GIA Diamond Dictionary (1993) and those given in earlier articles about this study (Hemphill, 1998; Reinitz, 2001). They replace those definitions, and brightness replaces brilliance, for the purposes of this description and the forthcoming the diamond cut grading system in accordance with the preferred embodiment. Also note that in addition to brightness, fire, and scintillation, the design and craftsmanship of a diamond, as evidenced by its physical shape (e.g., weight and durability concerns) and its finish (polish and symmetry), may also be significant indicators of a diamond's overall cut quality.

The gemstone cut grading system described herein can be partially or completely computer-implemented. In this regard, the system may be realized in one or more computer devices, which may be connected together in the form of a computer network. The details of computer hardware, network infrastructures, and software architectures are known to those skilled in the relevant arts, and therefore such details will not be described herein. Briefly, a computer-implemented gemstone cut grading system utilizes one or more computers configured to perform tasks, processes, and procedures described herein (and possibly other tasks).

The cut grading system may utilize standard desktop, laptop, palmtop, server-based, and/or any suitable computing device or architecture. In this regard, the computing arrangement is suitably configured to perform any number of functions and operations associated with the management, processing, retrieval, and/or delivery of data, and it may be configured to run on any suitable operating system such as Unix, Linux, the Apple Macintosh OS, or any variant of Microsoft Windows. Furthermore, the computing architecture may employ any number of microprocessor devices, e.g., the Pentium family of processors by Intel or the processor devices commercially available from Advanced Micro Devices, IBM, Sun Microsystems, or Motorola.

The computer processors communicate with system memory (e.g., a suitable amount of random access memory), and an appropriate amount of storage or "permanent" memory. The permanent memory may include one or more hard disks, floppy disks, CD-ROM, DVD-ROM, magnetic tape, removable media, solid state memory devices, or combinations thereof. In accordance with known techniques, operating system programs and the application programs associated with the cut grading system reside in the permanent memory and portions thereof may be loaded into the system memory during operation. In accordance with the practices of persons skilled in the art of computer programming, the present invention is described below with reference to symbolic representations of operations that may be performed by various computer components, elements, or modules. Such operations are sometimes referred to as being computer-executed, computerized, software-implemented, or computer-implemented. It will be appreciated that operations that are symbolically represented include the manipulation by the various microprocessor devices of electrical signals representing data bits at memory locations in the system memory, as well as other processing of signals. The memory locations where data bits are maintained are physical locations that have particular electrical, magnetic, optical, or organic properties corresponding to the data bits.

When implemented in software, various elements of the present invention are essentially the code segments, computer program elements, or software modules that perform the various tasks. The program or code segments can be stored in a processor-readable medium or transmitted by a computer data signal embodied in a carrier wave over any suitable transmission medium or communication path. The "processor-readable medium" or "machine-readable medium" may include any medium that can store or transfer information. Examples of the processor-readable medium include an electronic circuit, a semiconductor memory device, a ROM, a flash memory, an erasable ROM (EROM), a floppy diskette, a CD-ROM, an optical disk, a hard disk, a fiber optic medium, a radio frequency (RF) link, or the like. The computer data signal may include any signal that can propagate over a transmission medium such as electronic network channels, optical fibers, air, electromagnetic paths, or RF links. The code segments may be downloaded via computer networks such as the Internet, an intranet, a LAN, or the like.

The example embodiment described herein is suitable for use in grading round brilliant cut diamonds. The techniques of the invention, however, are not so limited. Indeed, a practical embodiment can be specifically configured to accommodate gemstone cut grading of different types of gems, different cut shapes, and different colored gems. Depending upon the particular application, different cut proportion parameters, different appearance algorithms and metrics, and different cut components may be handled by the cut grading system.

In connection with the development of the gemstone cut grading system described herein, researchers observed experienced diamond manufacturers, dealers, and retailers as they evaluated diamonds for brightness, fire, and overall appearance. Using these interactions as a foundation, a comprehensive diamond cut grading system was created, a number of diamond appearance metrics (e.g., brightness and fire metrics) were analyzed to find the best fit with human observations, the overall appearance results were compared with a number of appearance metrics, and a standard environment that mimics common trade environments was created. Briefly, the gemstone cut grading system considers the components of brightness, fire, a combined brightness/fire characteristic, scintillation, overweight, durability, polish, and symmetry. In practice, a light performance potential is first established by the metric calculations (i.e., the best grade possible considering the combination of proportions and how well they work together to return white and colored light to the observer) and then that potential can be further limited by the pattern-related, design-related, and craftsmanship-related deductions and calculations to account for any negative effects.

Computer modeling, observation testing, and trade interaction confirm that an attractive diamond should be "bright" in that it should return as much light as possible to the observer's eyes. An attractive diamond also should be "fiery" and "sparkling". It should throw off flashes of colored and white light as it moves relative to the observer. Furthermore, a diamond should have a pleasing overall appearance when viewed, especially in the face-up (table toward observer) position.

Some aspects of a pleasing appearance are seen as positive features, such as facet reflections of even, balanced size, and sufficient contrast between bright and dark areas of various sizes so that some minimal level of crispness (or sharpness) of the faceting is displayed in the face-up pattern. Other aspects of appearance are considered negative traits: for example, a diamond should not display a fisheye (i.e., girdle reflection seen through the table) or large dark areas in its pattern. Accordingly, the cut grading system considers pattern when scoring the overall appearance of a diamond.

It is recognized in the present invention that more than just face-up attractiveness should be considered when grading the cut of a gemstone. For example, craftsmanship, durability, and economy also should be evident. In particular, the following physical attributes are important: a gemstone should be carefully made, as shown by details of its polish and physical symmetry (assessed as the evenness of the outline of a diamond and the shape and placement of its facets); its proportions should not increase the risk of damage caused by its incorporation in jewelry and every-day wear (e.g., a round brilliant should not have an extremely thin girdle); and it should not weigh more than its appearance warrants (e.g., round brilliants that contain "hidden" weight in their girdles or look significantly smaller when viewed face-up than their carat weights would indicate).

Materials and Methods

This (third) stage of research evolved from that presented in two previous articles on diamond appearance (Hemphill et al., 1998; Reinitz et al., 2001). Initially, this stage was focused on exploratory testing to compare computer-modeled predictions of brightness and fire with observations by experienced trade observers of selected actual diamonds. We found that the observers generally agreed with each other but, in many cases, not with our predictions. We used these findings to create and test additional brightness and fire metrics, using a broader group of observers and diamonds.

Extensive observation testing with diamonds was desired in order to: (1) determine how well the original and subsequent metric predictions compared to actual observations; (2) establish thresholds at which differences defined by the model are not discerned by an experienced observer; (3) see the broad range of effects that might become statistically significant only with a large and varied sample of diamonds; (4) determine what additional factors must be considered when assessing diamond cut appearance and quality; and (5) supply enough data for overall preferences to be revealed amid the widely varied tastes of the participants.

Analysis of the observation data did reveal which metrics best fit our observation results. It also outlined discernible grade categories for our metric results by identifying those category distinctions that were consistently seen by observers. To determine what additional factors were not being captured by our computer model, we returned to the trade and asked individuals their opinions of diamonds that were ranked with our new brightness and fire metrics. Although a majority of these diamonds were ranked appropriately when metric results were compared to trade observations, many were not. By questioning our trade observers, and through extensive observations performed by a specialized team (the Overall observation team), we explored additional areas of face-up appearance (sparkle and pattern) and cut quality (design and craftsmanship) that proved to be advantageous when assessing a round brilliant's cut quality. Additionally, these observation tests supplied data that emphasized the usefulness of considering personal and global preferences when assessing and predicting diamond cut appearance and quality.

Last, we combined the findings of our observation testing and trade discussions with the predictive and assessment capabilities of our brightness and fire metrics to develop a comprehensive system comprised of all the factors identified in this latest phase of research. This provides the framework of the diamond cut grading system in accordance with the preferred embodiment.

Methods of Observation Testing

Testing for individual and market preferences is called hedonics testing (see, e.g., Ohr, 2001; Lawless et al., 2003) and is often used in the food sciences. Among the types of tests employed are acceptance tests (to determine if a product is acceptable on its own), preference tests (comparing products, usually two at a time), difference tests (to see whether observers perceive products as the same or different; that is, which levels of difference are perceptible), and descriptive analysis (in which observers are asked to describe perceptions and differences, and to what degree products are different). At various times throughout our research, we used each of these.

The observations focused on individual appearance aspects (such as brightness and fire) as well as on the overall cut appearance and quality of polished diamonds. The format and goal of each set of observation tests were determined by the question we hoped to answer (e.g., will pairs of diamonds ranked in brightness by our brightness metric appear in the same order to observers?), as well as by the findings of previous observation tests. In this way, as our study evolved, we varied the specific diamonds used in testing, the environments in which the diamonds were viewed, and the questions that we asked.

Since our first observation tests, we have collected more than 70,000 observations of almost 2,300 diamonds, by over 300 individuals. Approximately 200 observers were from all levels of the diamond trade or consumers, and about 100 were from the Gemological Institute of America (GIA) Gem Laboratory and other GIA departments, as described below.

The trade press has reported on the use of diamond observations to test appearance models (e.g., Scandinavian Diamond Nomenclature [SCAN DN] in 1967, mentioned by Lenzen, 1983; Nahum Stern at the Weitzmann Institute of Science in Israel, circa 1978 ["Computer used . . . ," 1978]), although to the best of our knowledge no results have been published. In addition, we at GIA have used statistical graphics in the past to explain observational results (see, e.g., Moses et al., 1997). Thus, this work is an application (and extension) of previously applied techniques.

Diamonds

We purchased and/or had manufactured a set of diamonds of various proportions (some rarely seen in the trade), so that the same set of samples would be available for repeated and ongoing observation tests. These 45 "Research Diamonds" made up our core reference set (see table 1). Some data on 28 of these diamonds were provided by Reinitz et al. (2001).

In our computer model, assumptions were made about color (D), clarity (Flawless), fluorescence (none), girdle condition (faceted), and the like. We recognized that actual diamonds seen in the trade might differ from their virtual counterparts in ways that would make the model less applicable. Therefore, to expand our sample universe, we augmented the core reference set with almost 2,300 additional diamonds (summarized in table 2) that came through the GIA Gem Laboratory. These diamonds provided a wide range of weights, colors, clarities, and other quality and cut characteristics. All of these diamonds were graded by the GIA Gem Laboratory and measured using optical measuring devices. In addition, we developed new methods for measuring critical parameters that previously had not been captured (for a description of the proportion parameters measured and considered, see FIG. 1).

TABLE 1

Properties of the core sample group of 45 Research Diamonds.[a]

| RD no. | Weight (ct) | Crown angle (°) | Crown height (%) | Pavilion angle (°) | Table size (%) | Total depth (%) | Star length (%) | Lower girdle length (%) | Girdle thickness | Girdle condition | Culet size | Clarity | Color | Fluorescence | Polish | Symmetry |
|---|---|---|---|---|---|---|---|---|---|---|---|---|---|---|---|---|
| 01 | 0.61 | 34.0 | 15.5 | 40.8 | 54 | 61.2 | 50 | 75 | Thin to medium | Faceted | None | $VS_1$ | E | None | Very good | Very good |
| 02 | 0.64 | 33.0 | 13.0 | 41.6 | 59 | 61.5 | 55 | 75 | Slightly thick to thick | Faceted | Very small | $SI_2$ | E | Faint | Very good | Good |
| 03 | 0.55 | 32.0 | 11.5 | 41.0 | 63 | 58.6 | 60 | 80 | Medium to slightly thick | Faceted | None | $VS_2$ | H | None | Good | Good |
| 04 | 0.70 | 36.0 | 15.5 | 42.0 | 58 | 65.4 | 55 | 80 | Slightly thick to thick | Faceted | None | $VVS_2$ | E | None | Good | Very good |

TABLE 1-continued

Properties of the core sample group of 45 Research Diamonds.[a]

| RD no. | Weight (ct) | Crown angle (°) | Crown height (%) | Pavilion angle (°) | Table size (%) | Total depth (%) | Star length (%) | Lower girdle length (%) | Girdle thickness | Girdle condition | Culet size | Clarity | Color | Fluorescence | Polish | Symmetry |
|---|---|---|---|---|---|---|---|---|---|---|---|---|---|---|---|---|
| 05 | 0.66 | 24.0 | 9.5 | 42.4 | 57 | 58.5 | 55 | 85 | Medium to slightly thick | Faceted | None | $VS_2$ | F | None | Very good | Good |
| 06 | 0.59 | 23.0 | 9.5 | 42.0 | 56 | 57.2 | 60 | 80 | Medium to slightly thick | Faceted | None | $VVS_2$ | F | Faint | Very good | Very good |
| 07 | 0.76 | 36.5 | 17.5 | 41.4 | 53 | 64.1 | 55 | 90 | Thin to medium | Faceted | None | $SI_1$ | F | None | Very good | Very good |
| 08 | 0.50 | 33.5 | 14.0 | 41.2 | 57 | 61.1 | 55 | 85 | Medium | Faceted | None | $VVS_1$ | H | None | Very good | Very good |
| 09 | 0.66 | 23.5 | 10.0 | 42.2 | 55 | 59.4 | 60 | 75 | Medium to slightly thick | Faceted | None | IF | F | None | Very good | Good |
| 10 | 0.68 | 34.5 | 16.0 | 41.0 | 54 | 62.1 | 55 | 75 | Very thin to medium | Faceted | None | $VS_2$ | G | None | Very good | Good |
| 11 | 0.71 | 37.0 | 16.0 | 42.2 | 58 | 64.9 | 45 | 85 | Medium to slightly thick | Bruted | None | $VS_2$ | D | None | Good | Very good |
| 12 | 0.71 | 35.0 | 15.0 | 41.0 | 57 | 62.6 | 55 | 75 | Medium to slightly thick | Faceted | None | $SI_1$ | F | None | Good | Very good |
| 13 | 0.59 | 33.5 | 16.0 | 41.2 | 52 | 61.9 | 60 | 80 | Thin to slightly thick | Faceted | None | $VVS_2$ | E | None | Very good | Good |
| 14 | 0.71 | 34.5 | 14.0 | 42.0 | 59 | 62.4 | 60 | 80 | Very thin to slightly thick | Faceted | None | $SI_1$ | G | None | Good | Good |
| 15 | 0.67 | 25.5 | 10.0 | 40.8 | 59 | 55.6 | 55 | 75 | Medium | Faceted | None | $VS_1$ | H | None | Good | Good |
| 16 | 0.82 | 33.5 | 15.5 | 40.6 | 53 | 61.2 | 50 | 75 | Thin to medium | Faceted | Very small | $VS_1$ | G | None | Good | Very good |
| 17 | 0.75 | 26.0 | 10.0 | 38.6 | 59 | 53.2 | 50 | 75 | Thin to medium | Faceted | None | $VS_2$ | F | None | Very good | Very good |
| 18 | 0.62 | 29.0 | 11.0 | 41.4 | 61 | 57.8 | 45 | 75 | Medium to slightly thick | Faceted | None | $VVS_2$ | H | None | Very good | Very good |
| 19 | 0.72 | 29.0 | 10.5 | 39.6 | 62 | 54.5 | 50 | 75 | Medium | Faceted | None | $VS_1$ | H | None | Very good | Very good |
| 20 | 0.62 | 34.5 | 13.5 | 40.8 | 61 | 59.6 | 55 | 80 | Medium | Faceted | None | $VVS_1$ | I | Strong blue | Very good | Very good |
| 21 | 0.82 | 35.5 | 15.5 | 41.2 | 58 | 62.3 | 55 | 75 | Thin to medium | Faceted | None | $VVS_1$ | I | Strong blue | Very good | Good |
| 22 | 0.81 | 35.5 | 16.5 | 39.4 | 54 | 60.6 | 55 | 75 | Thin | Faceted | None | $VS_1$ | K | None | Very good | Very good |
| 23 | 0.72 | 36.5 | 17.0 | 40.6 | 54 | 63.7 | 55 | 80 | Medium | Faceted | None | $VVS_2$ | I | None | Very good | Good |
| 24 | 0.58 | 35.5 | 12.5 | 39.0 | 66 | 56.3 | 60 | 75 | Thin to medium | Faceted | None | $VVS_1$ | H | None | Very good | Good |
| 25 | 0.82 | 40.0 | 13.0 | 42.0 | 69 | 60.2 | 55 | 75 | Thin to medium | Faceted | None | $VVS_2$ | H | None | Good | Very good |
| 26 | 0.89 | 38.0 | 15.0 | 42.0 | 61 | 63.3 | 55 | 70 | Medium | Faceted | None | $VS_1$ | I | None | Very good | Very good |
| 27 | 0.44 | 11.0 | 15.0 | 50.8 | 64 | 67.8 | 50 | 75 | Thin to medium | Faceted | None | $VS_2$ | G | Strong blue | Very good | Good |
| 28[b] | n/a | n/a | n/a | n/a | n/a | n/a | n/a | n/a | n/a | n/a | n/a | n/a | n/a | n/a | n/a | n/a |
| 29 | 0.69 | 37.5 | 15.5 | 42.2 | 60 | 62.9 | 50 | 75 | Thin to medium | Bruted | Small | $SI_1$ | F | Faint | Excellent | Excellent |
| 30 | 0.64 | 34.5 | 15.5 | 40.8 | 55 | 60.9 | 50 | 75 | Medium | Bruted | None | IF | I | None | Very good | Excellent |
| 31 | 0.41 | 27.0 | 11.5 | 40.4 | 57 | 58.8 | 50 | 75 | Slightly thick to thick | Faceted | Very small | $VS_2$ | E | None | Very good | Good |
| 32 | 0.64 | 35.0 | 16.5 | 41.0 | 53 | 60.5 | 45 | 60 | Medium to thick | Faceted | Slightly large | $VS_2$ | H | Medium blue | Very good | Good |
| 33 | 0.64 | 37.0 | 16.5 | 44.0 | 56 | 68.0 | 55 | 70 | Thin to medium | Faceted | None | $VS_1$ | H | None | Very good | Very good |
| 34 | 0.49 | 41.5 | 19.5 | 40.4 | 56 | 70.7 | 55 | 80 | Very thick | Faceted | None | $VS_1$ | H | None | Very good | Good |
| 35 | 0.44 | 31.0 | 9.0 | 43.2 | 70 | 58.4 | 65 | 80 | Thin to medium | Bruted | None | $VS_2$ | D | None | Good | Good |

TABLE 1-continued

Properties of the core sample group of 45 Research Diamonds.[a]

| RD no. | Weight (ct) | Crown angle (°) | Crown height (%) | Pavilion angle (°) | Table size (%) | Total depth (%) | Star length (%) | Lower girdle length (%) | Girdle thickness | Girdle condition | Culet size | Clarity | Color | Fluorescence | Polish | Symmetry |
|---|---|---|---|---|---|---|---|---|---|---|---|---|---|---|---|---|
| 36 | 0.65 | 37.0 | 16.5 | 43.4 | 57 | 67.9 | 55 | 75 | Medium to thick | Faceted | None | $VS_2$ | H | None | Excellent | Very good |
| 37 | 0.50 | 33.5 | 9.5 | 40.2 | 70 | 56.9 | 60 | 80 | Slightly thick to thick | Bruted | None | $VS_2$ | F | None | Good | Good |
| 38 | 0.70 | 37.0 | 16.5 | 41.6 | 57 | 69.1 | 60 | 85 | Very thick | Faceted | None | $VS_1$ | H | None | Very good | Good |
| 39 | 0.70 | 35.5 | 15.5 | 41.2 | 57 | 74.0 | 55 | 80 | Extremely thick | Faceted | None | $SI_1$ | F | Medium blue | Good | Good |
| 40 | 0.70 | 38.5 | 14.5 | 41.0 | 63 | 69.3 | 60 | 80 | Very thick to extremely thick | Faceted | None | $SI_1$ | G | None | Good | Good |
| 41 | 0.71 | 37.0 | 17.0 | 40.2 | 55 | 67.3 | 55 | 85 | Very thick | Faceted | None | $VS_2$ | H | Medium blue | Good | Good |
| 42 | 0.71 | 37.0 | 17.0 | 41.4 | 54 | 68.3 | 55 | 80 | Thick | Faceted | None | $VS_1$ | G | None | Good | Very good |
| 43 | 0.50 | 38.5 | 17.5 | 41.8 | 57 | 71.5 | 55 | 80 | Thick to very thick | Faceted | None | $VVS_2$ | G | None | Good | Good |
| 44 | 0.70 | 38.0 | 16.5 | 41.4 | 57 | 68.1 | 55 | 80 | Medium to very thick | Faceted | None | $VVS_2$ | I | Faint | Good | Good |
| 45 | 0.62 | 37.0 | 14.5 | 45.2 | 62 | 69.3 | 60 | 85 | Medium to very thick | Bruted | None | $VS_1$ | F | None | Good | Good |
| 46 | 0.54 | 37.0 | 14.5 | 37.2 | 62 | 54.5 | 60 | 85 | Extremely thin to thick | Bruted | None | $SI_2$ | F | None | Excellent | Good |

[a]Research Diamonds RD01–RD27 and RD29 were previously reported in Reinitz et al. (2001); variations in proportion values from that articles are the result of recutting, measuring device tolerances, and/or the application of rounding. Verbal descriptions are used here for girdle thickness and cutlet size, as they are reported by the GIA Gem Laboratory. Listed properties were determined by the GIA Gem Laboratory.
[b]Not included in sample set for this research because it is a modified round brilliant.

TABLE 2

Ranges of properties and proportions for 2,298 other diamonds used for verification testing.[a]

| Parameter | Brightness and fire verification diamonds | Overall Verification Diamonds (OVDS) |
|---|---|---|
| No. of diamonds | 688 | 1,610 |
| Weight range | 0.20–1.04 ct | 0.25–14.01 ct |
| Clarity | Internally flawless-$I_3$ | Internally flawless-$I_3$ |
| Color | D–Z | D–Z |
| Fluorescence intensity | None to very strong | None to very strong[b] |
| Fluorescence color | Blue | Blue, white, yellow[b] |
| Table size | 52–72% | 46–74% |
| Crown angle | 23.0–42.5° | 22.5–42.0° |
| Pavilion angle | 37.6–45.6° | 37.2–44.0° |
| Lower-girdle facet length | 60–95% | 55–95% |
| Star facet length | 40–70% | 35–70% |
| Depth percent | 51.5–71.2 | 52.8–72.0 |
| Crown height | 7.0–20.0% | 6.5–19.5% |
| Polish | Excellent to fair | Excellent to fair |
| Symmetry | Excellent to fair | Excellent to fair |
| Culet size | None to very large | None to very large |
| Girdle thickness | Very thin to extremely thick | Very thin to extremely thick |
| Girdle condition | Faceted, polished, bruted | Faceted, polished, bruted |
| Total no. observations per diamond | 9–29 | 3–15 |
| Brightness observations per diamond | 3–11 | 0[c]–3 |

TABLE 2-continued

Ranges of properties and proportions for 2,298 other diamonds used for verification testing.[a]

| Parameter | Brightness and fire verification diamonds | Overall Verification Diamonds (OVDS) |
|---|---|---|
| Fire observations per diamond | 5–15 | 0[c–4] |
| Overall appearance observations per diamond | 1–3 | 3–8 |

[a]See FIG. 1 for a description of diamond proportions mentioned in this table.
[b]We saw only an extremely small number of fluorescent diamonds in the very strong range, or in white or yellow; we found the effects of these particular qualities to be insignificant for the diamonds observed.
[c]Brightness and/or fire observations were not conducted for some of the Overall Verification Diamonds.

In Table 2, "OVD" means "overall verification diamonds," "B & F" means "brightness and fire," the girdle thickness is measured at the thickest point of the girdle (i.e., where bezels meet pavilion mains), and girdle condition is listed as either "F" (faceted) or "B" (bruted).

Observers

Experienced diamond manufacturers and brokers make purchasing and cutting decisions based on aesthetic and economic considerations. To begin the verification process for our brightness and fire metrics, we watched these individuals as they examined diamonds from our samples, both in the environments where they usually make their daily decisions about diamond cut and appearance, and in a variety of controlled environments (detailed below). In general, we asked them what we thought were straightforward questions: "Which of these diamonds do you think is the brightest, the most fiery, and/or the most attractive overall? What differences do you see that help you make these decisions?"

Interactions with trade observers were used in two ways. First, they provided an initial direction for this stage of our research project, reinforcing which aspects of cut quality should be considered in addition to brightness and fire. Subsequently, they served as guidance; throughout our research, we returned to trade observers to compare against the findings we received from our internal laboratory teams.

A summary of our observers (including number and type) is given in table 3. Our core trade observers ("Manufacturers and Dealers" and "Retailers" in table 3) are experienced individuals from around the world who routinely make judgments on which their livelihoods depend about the quality of diamond manufacture. Many of these men and women have decades of experience in the diamond trade, and most of them routinely handle thousands of polished diamonds per week.

observers. Early testing showed that the responses of this group were consistent with those of the trade observers.

Two other groups who took part in observations were less experienced (or less diamond-focused) trade members and consumers. In this way, we met our goal of considering observations from people at all levels of the diamond trade, as well as consumers.

Viewing Environments

To discover how individuals in the trade normally evaluate diamonds on a day-to-day basis, we asked them detailed questions about their working environments, and we observed them while they assessed diamonds in these environments. This revealed their everyday observation practices such as colors of clothing, colors of the backgrounds on which they viewed diamonds, light intensity, lighting and viewing geometry, light-source specification, and how they held and moved diamonds when viewing them. Table 3 provides an illustrative summary of observers and types of observations.

TABLE 3

Summary of observers and types of observations.

| | Total observers | | GIA Gem Laboratory observers[a] | | | | | |
|---|---|---|---|---|---|---|---|---|
| Observation group | Manufacturers and dealers | Retailers[b] | Brightness team | Fire team | Overall observation team | Additional GIA personnel[c] | Consumers[d] | Total |
| No. of individuals | 37 | 159 | 7 | 6 | 6 | 141 | 28 | 384 |
| Types of observations | Brightness, fire, overall | Brightness, fire, overall | Brightness | Fire | Overall | Brightness, fire, overall | Brightness, fire, overall | |

[a]Each of these three teams was composed of members who were not part of other teams.
[b]Includes sectors of the trade that work with the public, such as appraisers.
[c]Includes individuals from the Research department, the GIA Gem Laboratory, and GIA Education.
[d]Includes non-gemological individuals from trade shows and GIA.

Because retailers typically sell diamonds in different environments from those in which manufacturers and dealers evaluate them, we generally analyzed their observations separately. The results of these trade observations were used to define our initial quality ranges for brightness, fire, and overall face-up appearance, as well as to provide useful information on other essential aspects of diamond cut quality.

To expand our population of experienced diamond observers, we also established several "surrogate" teams of individuals from the GIA Gem Laboratory to carry out the numerous observations that we conducted. We developed a team of "brightness observers" who saw the same differences in brightness (within a five-diamond set of our Research Diamonds, RD01-RD05; again, see table 1) as our trade observers did in a comparable environment. We assembled a different group of specialized individuals to serve as our "fire observers." Last, we assembled a team of six individuals from the GIA Gem Laboratory (our Overall observation team) who combined had more than 100 years of experience viewing diamonds. This team, whose members did not participate in any of the other teams, conducted several sets of tests that focused on judging diamonds for their overall cut appearance and quality. The GIA Gem Laboratory observers were asked to examine larger populations of selected diamonds, and to answer the same kinds of questions as those posed to the trade Our observers examined diamonds in a number of different environments, some variable and some controlled, including:

(1) Their own offices and workplaces (using desktop fluorescent lamps);

(2) A conference room at the GIA offices in New York (using similar desk lamps and/or the viewing boxes described below);

(3) Retail showrooms (usually consisting of a mix of fluorescent and spot lighting);

(4) "Retail-equivalent" environments at GIA in Carlsbad and New York, set up according to recommendations by a halogen light-fixture manufacturer (Solux);

(5) Standardized color-grading boxes, including two commercially available boxes (the Graphic Technology Inc. "Executive Show-Off" Model PVS/M—the "GTI" environment—and the Macbeth Judge II Viewing Booth, both with daylight-equivalent D65 fluorescent lights);

(6) At least three versions of a standardized viewing box of our own design (the common viewing environment, or "CVE"); and (7) A variety of patterned hemisphere environments (to imitate computer-modeled environments).

The same diamond can look quite different, depending on the type and position of lighting that is used. On the one hand, for cutting diamonds and for evaluating brightness and the quality of diamond cutting in general, most manufacturers use overhead fluorescent lights and/or desk lamps with daylight-equivalent fluorescent bulbs; dealers and brokers generally use similar desk lamps in their offices. However, this type of diffuse lighting suppresses the appearance of fire. On the other hand, retail environments generally provide spot, or point source, lighting (usually with some overall diffuse lighting as well) to accentuate fire. Therefore, when we wanted solely to study the effects of brightness, we used dealer-equivalent lighting, which included daylight-equivalent fluorescent lights mounted in fairly deep, neutral-gray viewing boxes (e.g., the Macbeth Judge II, as is used for color grading colored diamonds; see King et al., 1994). Similarly, when we wanted to study only the effects of fire, we used our retail-equivalent lighting, which included a series of three halogen lamps mounted 18 inches (about 46 cm) apart and six feet (1.8 m) from the surface of the work table, in a room with neutral gray walls that also had overhead fluorescent lights.

For observation of overall cut appearance, we developed a GIA "common viewing environment" (CVE [patent pending]), a neutral gray box (shallower than the Macbeth Judge II or GTI environment) with a combination of daylight-equivalent fluorescent bulbs and overhead white LEDs (light-emitting diodes). We established the optimum intensity of the fluorescent bulbs by observing when a set of reference diamonds showed the same relative amounts of brightness as they showed in the dealer-equivalent lighting. The intensity of the LEDs was determined by identifying a level at which fire was visible in diamonds but the relative amounts of brightness were still easy to observe accurately. In this way, we were able to observe brightness and fire in a single viewing environment that preserved the general qualities of both dealer and retail lighting.

We also investigated the effects of background color (that is, the color in front of which diamonds were observed). Our computer models for brightness and fire assumed a black background; yet we found that most people in the diamond trade use white backgrounds of various types (often a folded white business card) to assess diamond appearance. Our observation teams assessed diamonds for brightness and fire on black, white, and gray trays to determine if tray color affected brightness and fire results. Additionally, our Overall observation team observed diamonds on various color trays to determine their effect on overall cut appearance.

Figure 2:
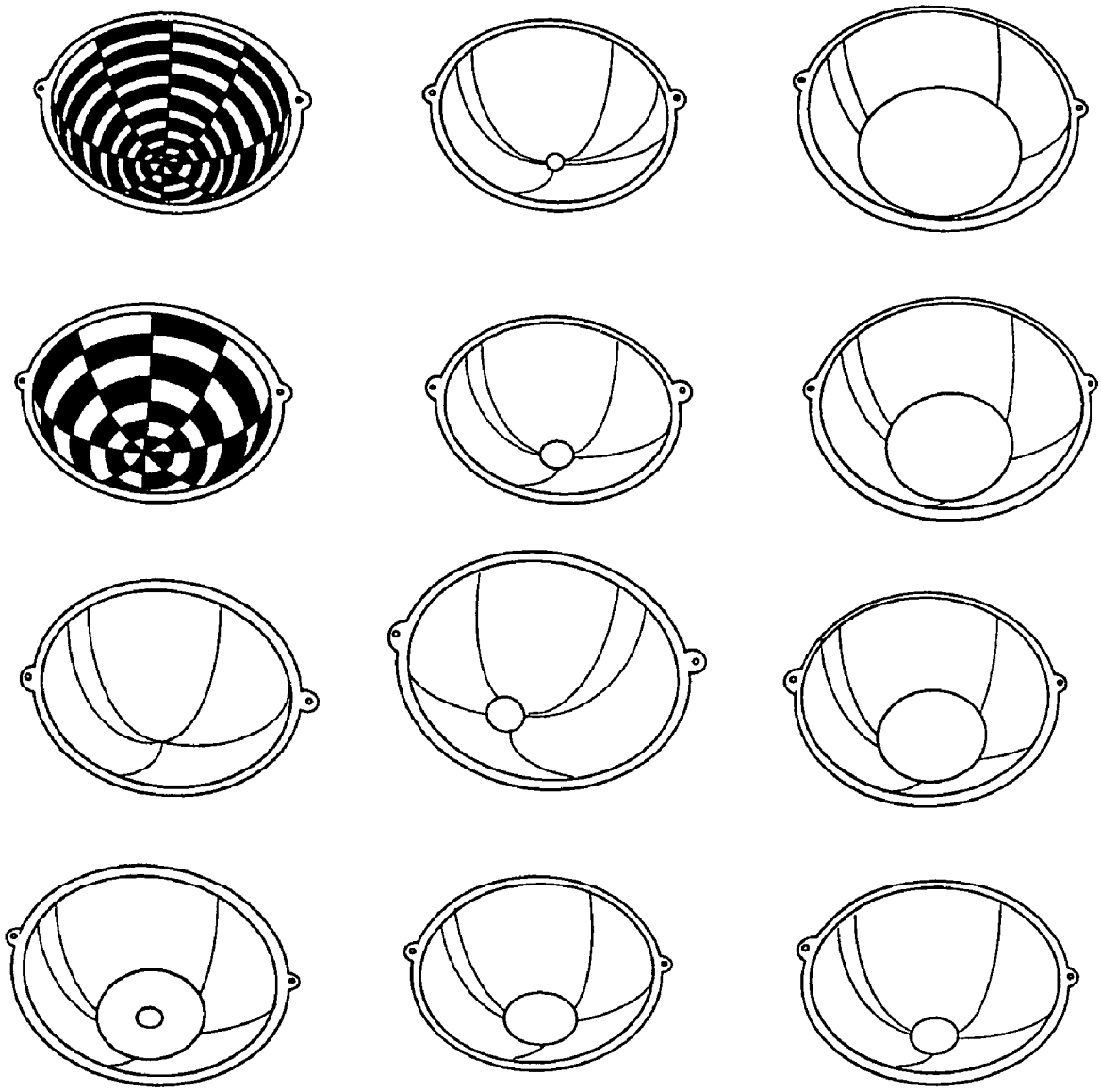
FIG. 2 is a perspective view of the inner surfaces of example viewing hemispheres.
Figure 3:
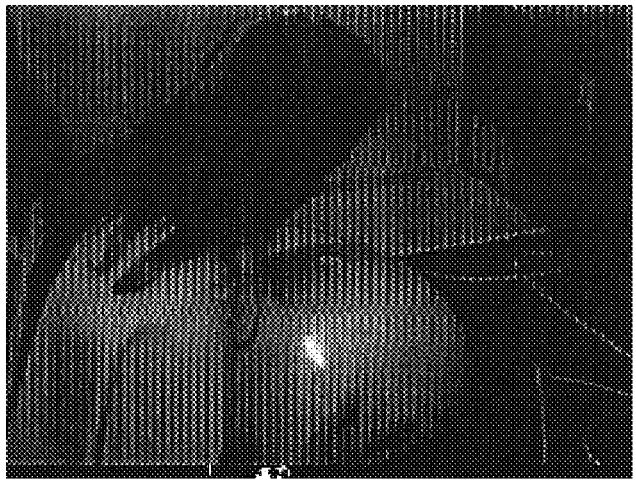
FIG. 3 is an illustration of an observer viewing a gemstone within a viewing hemisphere.

For the Brightness and Fire teams, additional viewing devices were sometimes employed, especially in the early stages of investigation. To test our axially symmetric (that is, hemisphere-like) brightness metrics, we built patterned hemispheres (FIGS. 2 & 3; see table 1 in the Gems & Gemology Data Depository at www.gia.edu/gemsandgemology) of various sizes (6, 12, and 16 inches—about 15, 30, and 41 cm—in diameter) in which the diamonds were placed while observers evaluated their relative brightness. The inner patterns of example hemispheres are depicted in FIG. 2, while the manner in which an observer may view a diamond is depicted in FIG. 3. The results of these hemisphere observations were also compared to results from the more typical trade environments discussed above (see table 4, below, "brightness verification"). To be rigorous in our investigation, we examined a wider range of hemispheres than we believed were necessary solely to test our brightness metrics. In addition, we constructed a "fire training station," an environment including a light source and a long tube that enabled fire team observers to grow accustomed to seeing finer distinctions of dispersive colors in diamonds, and to distinguish among diamonds with different amounts of fire. Once they were comfortable in the fire training station, observers made evaluations of fire in our retail-equivalent lighting (described above) and, eventually, in our CVE (see table 4, below, "fire verification").

TABLE 4

Summary of observation tests.

| Type of observation | Viewing environment[a] | Type of observer[b] | Diamond samples used[c] | Comparison method[d] | Total no. of observations |
|---|---|---|---|---|---|
| Brightness | Manufacturer-equivalent, retail-equivalent, Judge | M&D, GIA personnel, consumers, B-team | RD01–RD46 | Binary, 3x rank, 5x rank | 9,996 |
| Brightness: metric verification | GTI and CVE | GIA personnel and B-team | Diamonds borrowed from other sources[e] | Binary with comparison "master" diamonds | 11,418 |
| Brightness: metric verification | Various domes | GIA personnel and B-team | RD01–RD-46 | Binary, 3x rank, 5x rank | 17,843 |
| Brightness: environment consistency | GTI, Judge | B-team | Set 1 | Binary | 280 |
| Fire | Manufacturer-equivalent, retail-equivalent | GIA personnel, B-team, M&D | RD01–RD46 | Binary, 5x rank | 688 |
| Fire: metric verification | Retail-equivalent and CVE | F-team | Diamonds borrowed from other sources[e] | Binary with comparison "master" diamonds | 11,992 |
| Scintillation | Retail-equivalent | GIA personnel, B-team, F-team | Set 1, set 2, diamonds borrowed from other sources[e] | 5x rank | 2,122 |
| Overall | Retail-equivalent and CVE | GIA personnel, B-team, F-team, retailers, consumers | RD01–RD46 | 5x rank, Good/Fair/Poor rank; dividing diamonds into groups | 3,608 |
| Overall: metric verification | CVE | Overall observation team | Diamonds borrowed from other sources[e] | Binary with comparison "master" diamonds | 3,549 |
| Overall: environment consistency | CVE with and without multiple light sources | Overall observation team | RD01–RD46 | Binary with comparison "master" diamonds | 396 |

TABLE 4-continued

Summary of observation tests.

| Type of observation | Viewing environment[a] | Type of observer[b] | Diamond samples used[c] | Comparison method[d] | Total no. of observations |
|---|---|---|---|---|---|
| Brightness, fire, scintillation, and overall | Retailer environments | Retailers | Set 1, set 2 | 5x rank | 1,370 |
| Overall verification (brightness, fire, overall) observations | CVE | F-team, B-team, Overall observation team | Diamonds borrowed from other sources[e] | Binary with comparison "master" diamonds | 7,580 |

[a]As described in the Materials and Methods section: GTI = Graphic Technology, Inc. "Executive Show-Off" Model PVS/M; Judge = Macbeth Judge II Viewing Booth; CVE = the GIA common viewing environment.
[b]Observers are listed as B-team (Brightness team), F-team (Fire team); and M&D (Manufacturers and Dealers). See Materials and Methods section and table 3 for a description of these teams.
[c]Set 1 consisted of RD01, RD02, RD03, RD04, and RD05; set 2 consisted of RD08, RD11, RD12, RD13, and RD14. See table 1 for properties.
[d]Comparison methods used were binary rank (two diamonds side-by-side), 3x rank (three diamonds side-by-side), and 5x rank (5 diamonds side-by-side). "Master" diamonds were chosen from the Research Diamonds.
[e]Summarized in table 2.

Figure 4:
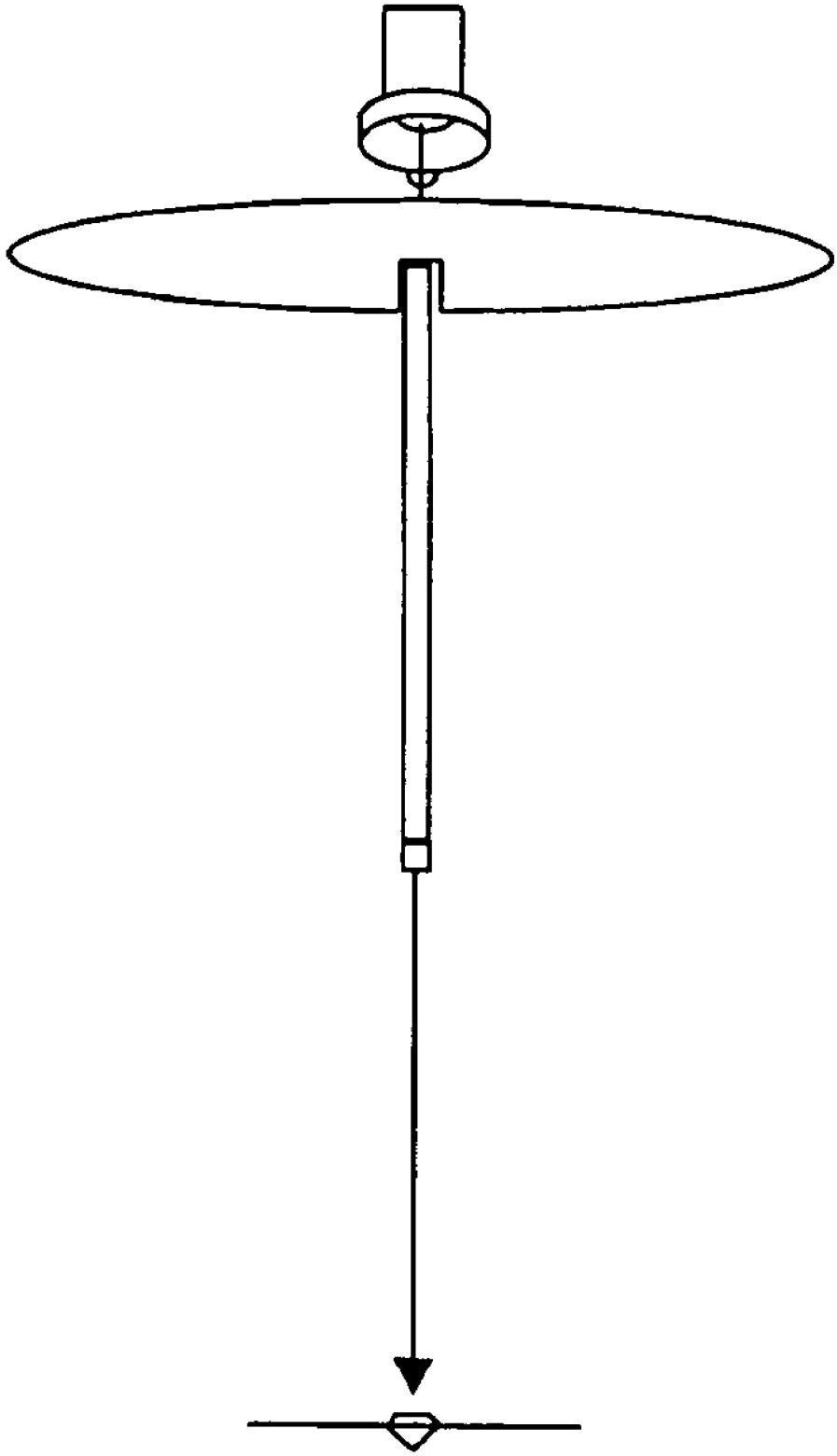
FIG. 4 is a schematic representation of a fire training station.

In addition, a "fire training station" was constructed to allow observers to grow accustomed to viewing fine distinctions of dispersive colors in diamonds and to distinguish among diamonds with different amounts of fire. The fire training station includes a light source and a long tube as shown in FIG. 4. Once comfortable in the fire training station, observers made observations of fire using retail-equivalent lighting (described above), and, eventually, in the CVE.

Evaluation of Brightness and Fire Metrics

We collected relative brightness and fire observations on diamonds in many environments, and we examined a number of possible brightness and fire metrics. To compare metric values with observation results, we had to convert both into rank orders.

Members of the Brightness and Fire teams compared each of the Research Diamonds to each other in pairs for brightness or fire, respectively. This gave 990 binary comparisons under each condition. As is typical with observation data, not all observers agreed on every result (although some results were unanimous). This makes sense if the relative ranking of two diamonds is not considered simply as a measurement, but as a measurement with some accompanying uncertainty; that is, a distribution of values. (For example, 4 is always a larger number than 3 which is a larger number than 2; but a number measured as 3±1.2 could in fact be greater than 4 or less than 2.) We therefore assumed that the observed brightness (or fire) rank for each diamond could be represented by a probability distribution, and then found the relative order that maximized the probability of obtaining the observational data we had.

Sometimes, the data showed that all observers saw one diamond to be better (or worse) than all the others. In such a case, all the pair-wise comparisons to that diamond were removed from the data set; this process was repeated, if necessary, to determine the relative order of the remaining diamonds, from which overall rankings could then be made.

For both observed ranks (described above) and metric ranks (based on their metric values), we used scaled rank orders (i.e., the orders did not have to be an integer value, but the highest-ranking diamond came in first, and the lowest-ranking diamond came in 45th).

The scaled-rank data sets were compared using the Pearson Product Moment Correlation. This method produces the "r"-value seen in linear correlations (see, e.g., Kiess, 1996; Lane, 2003). The metric with the highest r-value to the observed data was selected as the best fitting metric.

We then used Cronbach's alpha (see, e.g., Cronbach, 1951; Nunnally, 1994; Yu, 1998, 2001) to test the reliability of the metric predictions relative to our observers. Cronbach alpha values range between 0 and 1, with near-zero values representing non-correlated sets of data. Values of 0.70 and higher are considered acceptable correlations for reliability. More importantly, if results from a predictive system are added to a dataset as an additional observer and the alpha coefficient remains about the same, then that system is strongly correlated to (i.e., is equally reliable as) the observers.

Early Observation Testing: Brightness and Fire

Our Brightness team examined a set of five Research Diamonds, RD01-RD05 (see table 1), for brightness differences in the dome environments described above. We confirmed that the predictions of a specific brightness metric (the relative brightness order of the five diamonds) matched the observations of the Brightness team in the environment for that metric. We then used relative observations of 990 pairs of diamonds (our core reference diamonds; see table 1 and above description under heading Evaluation of Brightness and Fire Metrics) in dealer-equivalent lighting to select the appropriate brightness metric; that is, we adjusted the modeling conditions (e.g., lighting conditions or viewing geometry) of our brightness metrics until we found one that predicted brightness ranking in the same order as the observation results.

Next, we trained the Fire team to see relative amounts of fire consistently and asked them to compare the same 990 pairs of diamonds in a retail-equivalent environment that emphasized this appearance aspect. Then, as we did with the brightness metric, we varied the modeling conditions (in this case, the threshold levels of discernment) of the Reinitz et al. (2001) fire metric to get the best fit with these observations in this environment.

As part of this early testing process, we also chose almost 700 diamonds with varying quality characteristics (i.e., with a wide range of clarity, color, symmetry, polish, fluorescence, etc.) and had both our Brightness and Fire teams observe them for brightness and fire in the dealer- and retail-equivalent environments. We compared these observations to brightness and fire metric results to determine whether any of these characteristics significantly affected the correlation between the two.

Later Observation Testing: Overall Cut Appearance and Quality

We used several methodologies for observation testing of overall cut appearance and quality. One method was to ask observers to look at five diamonds at a time and rank them from brightest, most fiery, and/or best looking to least bright, least fiery, and/or worst looking (we also did this using three diamonds at a time). We conducted later comparisons in a "binary" fashion (that is, comparing two diamonds at a time from a set, until each diamond had been compared to every other diamond in the set). We also conducted observations in which diamonds were compared against a small suite of Research Diamonds chosen from the core reference set. A fourth methodology consisted of asking observers to examine larger sets (10 to 24 diamonds) and order them by overall appearance into as many groups as they wished (for a detailed summary of observation tests, see table 4).

In early sessions, participants were asked to observe diamonds face-up, without a loupe, while the diamonds were in the observation tray. However, we did not restrict their ability to move or tilt the diamonds, and in most cases participants tilted or "rocked" them during their examination. Later, when we conducted observations on overall cut quality (as opposed to just face-up appearance), we allowed participants to examine the profiles of the diamonds (using a loupe and tweezers) after they had provided their first impressions of the diamonds. This process further helped us recognize the importance of craftsmanship and other factors in the assessment of overall cut quality.

In all of these observations, participants were asked to rate diamonds based solely on face-up appearance or on each diamond's overall cut quality. Participants were also asked to detail the reasons for their decisions (e.g., localized darkness in the face-up appearance or girdles that were "too thick"). These responses along with the participants' rankings were then used to develop a methodology for accurately predicting a diamond's overall cut appearance and quality.

Computer Modeling and Calculations

Our computational methods for the modeling of brightness and fire were essentially the same as those given in our two previous papers (Hemphill et al., 1998; Reinitz et al., 2001). Although our modeling software is custom and proprietary, it can be used on any computer that can run programs written in the C language; to calculate the metric results for almost one million proportion combinations, we ran them on sixteen 500 MHz Pentium III processors (later updated to sixteen 2.5 GHz Pentium IV processors) and two 2.4 GHz Pentium IV processors.

Metrics

We generated more than 75 different, yet related, brightness and fire metrics to compare with our ongoing observations (see table 2 in the Gems & Gemology Data Depository at www.gia.edu/gemsandgemology). To define an appearance metric, assumptions must be made about: the modeled diamond, the modeled observer (position and angular spread of observation), the modeled environment (including illumination), and the property being quantified.

In the metrics for this work (compared to those presented in Hemphill et al., 1998 and Reinitz et al., 2001), we varied:

(1) The position of the observer and the angular spread of observation (from 180° to 3°) for brightness;

(2) The distribution of dark and light in the environment (from all white to white with a black circle of 23° radius located directly over the table) for brightness;

(3) The presence or absence of front-surface reflections (specular reflection, or "glare") for brightness; and (4) The visual threshold (from 3,000 to 18 observer discernment levels for light intensity) for fire. (This was an explicitly variable factor in our fire metric; again, see Reinitz et al. 2001.)

As before, the proportions of the modeled diamonds were the input parameters that determined the metric values, so the proportion sets could vary without changing the fundamental nature of the metrics. Also as in our earlier articles, the computer-modeled diamonds were colorless, non-fluorescent, inclusion-free, and perfectly polished. Although at first we assumed the diamonds were completely symmetrical, later we measured all the facets on certain diamonds to input their exact shapes into metric calculations.

Comparison of the observation results with the metrics proved to be quite challenging, and details of some of the statistical methods we used are summarized under the above heading Evaluation of Brightness and Fire Metrics. These tools enabled us to decide which of our metrics were the most appropriate to predict levels of brightness and fire (i.e., the calculated appearance values that best matched results from observers looking at actual diamonds).

Our new metrics were based on the previously published WLR and DCLR metrics and then further developed by varying observer and environmental conditions, and the effect of glare, until we found sets of conditions that best fit the observation data in dealer- and retail-equivalent environments. The Hemphill et al. (1998) WLR (weighted light return) metric for brilliance and the Reinitz et al. (2001) DCLR (dispersed colored light return) metric for fire both assume a distributed observer who is positioned over the entire hemisphere, above the diamond, infinitely far away. The weighting for each possible angle of observation is determined by an angular relationship to the zenith of the hemisphere. (The zenith, looking straight down on the table of the diamond, is weighted the strongest in the final result; this is like someone who rocks the diamond, but allows the table-up view to create the strongest impression.)

To obtain stronger correlations with our diamond observation results, this time we also modeled a localized observer. This virtual observer only detected light from the diamond from a face-up position and within a narrow 3° angular spread area (like a person who looks at a diamond from a mostly fixed position and from a reasonably close distance, in this case about 14-20 inches, or roughly 36-51 cm, as we noted in most trade observations). Although the published WLR observer did not detect light reflected directly from the upper surfaces (that is, glare, or luster), for this work we considered brightness metrics both with and without glare. As for previous metrics, we assumed our observer had normal color vision.

Another factor to consider when modeling an observer for fire is the visual threshold at which an individual can readily detect colored light. In our previous research (Reinitz et al., 2001), we determined visual thresholds by using a hemisphere on which chromatic flares from the crown of a polished diamond were reflected. With this hemisphere, we concluded that $10^{3.5}$ (about 3,000) levels of intensity of the colored light could be observed. In the course of our observation tests for fire discernment, we found that an individual could observe more levels of intensity with this hemisphere than when observing fire directly from the crown of a polished diamond. Thus, for the present work we varied this threshold in our metric until we found the best fit with observation results.

The environment for the WLR metric was assumed to be a hemisphere of uniform (that is, fully diffused) illumination above the diamond's girdle (everything below the diamond's girdle is dark). By contrast, for the present work we were trying to model environments and lighting conditions used in the trade to buy or sell diamonds. Real-life environments for observing brightness are considerably more complicated. For example, light around a diamond often is disrupted by objects in the room, and much of the light directly over a diamond's table is reflected off the observer. We modeled hemispheres with various patterns of light and dark (again, see FIGS. 2 & 3) until we found a modeled environment that closely correlated with the brightness results from typical trade environments.

The environment for the DCLR metric was a uniformly dark hemisphere (again, above the diamond's girdle, with all space below the girdle plane also dark) with parallel rays of illumination coming from a point light source, centered over the table. This is a reasonable approximation of a single spot light (for an observer who is not blocking the light source, and who is rocking the diamond a lot) or of many, arbitrarily placed spot lights, including one above the diamond, for an observer who rocks the diamond only a little. For our current research, we adjusted the visual discernment thresholds within the metric to improve correlation with actual observations of fire in retail-equivalent lighting and viewing environments. This change in metric thresholds was the only one needed to create a new fire metric that correlated well with fire observations.

Finally, the property being quantified by WLR (and our new brightness metric, discussed below) was the total amount of white light returned to the observer from the crown of the diamond (in the case of the new brightness metric, this includes glare); for DCLR, it was the amount of dispersed colored light (i.e., fire) returned to the observer. Table 5, below, summarizes these model conditions.

TABLE 5

Comparison of old and new model conditions for calculating brightness and fire.

| Property | Metric | Modeled observer | Modeled environment | Other factors |
|---|---|---|---|---|
| Brightness | Old | Spread over 180° above diamond and "weighted" | White hemisphere | No glare |
| | New | Localized 3° angular spread | Dark circle with radius of 23° around zenith | Glare included |
| Fire | Old | Spread over 180° above diamond and "weighted" | Dark hemisphere | Large threshold-3,000 brightness levels |
| | New | Spread over 180° above diamond and "weighted" | Dark hemisphere | Small threshold-18 brightness levels |

Calculations Derived from Standard Proportion Parameters

From the eight proportion parameters (table size, crown angle, pavilion angle, star length, lower girdle length, culet size, girdle thickness, and number of girdle facets; again, see FIG. 1) describing a perfectly symmetrical round brilliant cut diamond with a faceted girdle, it is possible to calculate other proportions and interrelationships. These include not only commonly quoted proportions such as crown height, pavilion depth, and total depth, but also, for example:

(1) Facet geometry (e.g., facet surface areas and inter-facet angles);

(2) Extent of girdle reflections in the table when viewed face-up (i.e., if too extensive, a "fisheye" effect);

(3) Extent of table reflections in the table when viewed face-up;

(4) Several parameters related to localized darkness in the crown when viewed face-up; and (5) Weight-to-diameter ratio.

We ran such calculations for all the Research Diamonds and for most of the diamonds in table 2; these were used to explore scintillation aspects (see below) and other factors related to the physical shape (e.g., weight concerns) of the diamonds.

Evaluation of Overall (Face-Up) Cut Appearance

Figure 6:
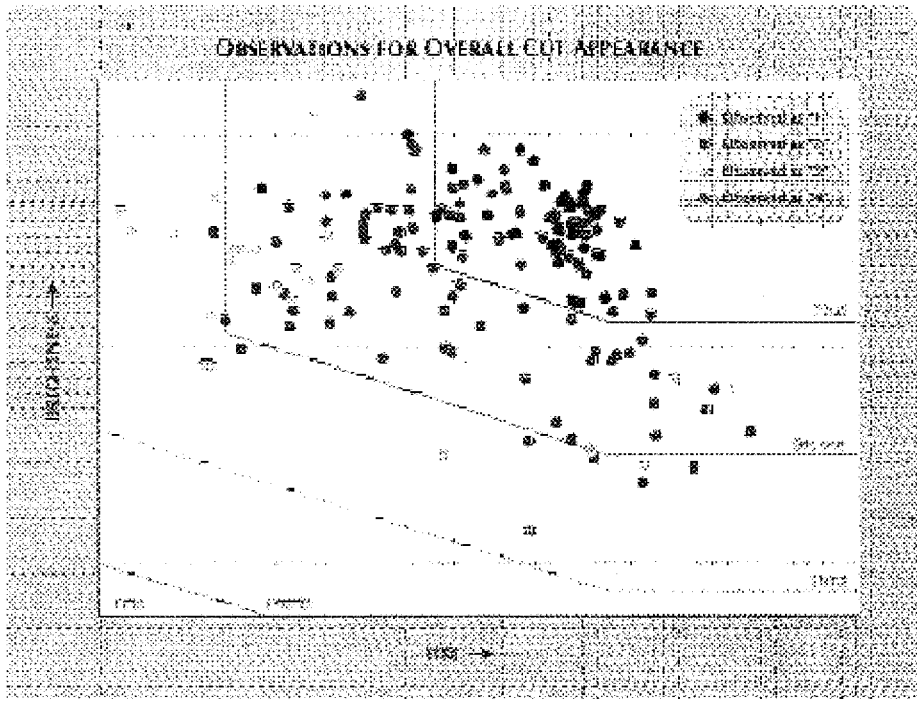
FIG. 6 shows a graph of observations for overall cut appearance.

Our initial observation tests revealed that, as we expected, our best brightness and fire metrics were able to predict specific observation results (i.e., brightness and fire), but they were not adequate to predict and evaluate a diamond's overall cut appearance and quality. An example of this can be seen in FIG. 6, which displays brightness and fire metric results for 165 representative diamonds evaluated by our Overall observation team for their overall face-up cut appearance. The boundaries on this plot delineate five discernible appearance categories, which were based on observation results for brightness and fire previously obtained for the Research Diamond set. Of these 165 diamonds, 95 (58%) were accurately predicted using brightness and fire metrics alone. In addition, all the diamonds were within one category of the predicted result based only on a combination of calculated brightness and fire results.

Obviously, additional factors played a significant role in the observation results for the remaining 42% of these diamonds. Hence, the next stage of our investigation concerned how to identify and correctly evaluate those diamonds for which the brightness and fire metric results alone did not accurately predict overall cut appearance, without affecting the results for diamonds already adequately "predicted."

With this in mind, we looked at comments provided by trade observers and the Overall observation team on the visual appearance of every diamond they examined. In many cases, these comments supported the metric results (for example, that a diamond was dark overall). In other cases, the observers' comments described appearance effects that caused the diamond to look worse than expected on the basis of brightness and fire alone. When we studied these additional appearance factors, we recognized them as various aspects of scintillation.

We used specific comments provided by the Overall observation team and by members of the diamond trade to develop methods of capturing scintillation aspects of overall (face-up) appearance that were not being addressed by our brightness and fire metrics. We used several rounds of observation tests (listed together in table 4) to create and test a methodology for identifying, quantifying, and categorizing the various effects that indicate deficiencies in scintillation.

Members of our Overall observation team compared "Overall Verification Diamonds" (OVD; again, see table 2), one at a time, to a suite of appearance comparison diamonds assembled from our Research Diamonds. (Some OVDs were looked at more than once, and some were also observed by the Brightness and Fire teams.) Observations were done in the CVE environment on gray trays (which, at this point, we had determined were most appropriate for assessing cut appearance; see Results). These observers were asked to rank diamonds on a scale of 1-5, and to provide specific reasons for the rankings they gave. We used these reasons (which were in the form of descriptions about each diamond's appearance) to find ways to predict specific pattern-related scintillation aspects that caused a diamond to appear less attractive than expected from our brightness and fire metrics.

This developed into a system for addressing those diamond proportion sets that led to lower-than-expected appearance rankings (due to pattern-related scintillation). We used proportion-range limits along with proportion-derived calculations to predict specific pattern-related effects.

As we completed each set of observations, we developed and refined our pattern-related methodology, so we could test its efficacy during the next set of observation tests. In this way, we refined proportion-range borders as appropriate, adding new predictive calculations as needed. Thus, we were able to use early test results to address the additional aspects that observers considered (either consciously or unconsciously) while assessing overall cut appearance in later tests. In addition, the tens of thousands of observations we conducted during this process have provided a real-world confirmation of our predictive system, allowing us to feel confident in predicted results, even in cases where we may not have seen a diamond with that specific set of proportions.

Scintillation

In recent history, scintillation has been defined as the "flashes of white light reflected from a polished diamond, seen when either the diamond, the light source, or the observer moves" (see, e.g., GIA Diamond Dictionary, 1993, p. 200). This was widely recognized as the third essential appearance aspect that worked with brightness and fire to create the overall face-up appearance of a diamond.

However, we found through our interaction with members of the diamond trade and our overall observation tests that scintillation encompasses more than just this flashing of light. When asked about the face-up appearance of the diamonds they were observing, many trade members also mentioned the importance of the distribution of bright and dark areas seen in the crown of a diamond. Differences in this distribution, especially changes brought on when the diamond moves, were seen to underlie and influence the flashes of light described in the above definition of scintillation.

Thus, given the interdependence of flashing light and distribution, we decided to use two terms to represent these different aspects of scintillation. Sparkle describes the spots of light seen in a polished diamond when viewed face-up that flash as the diamond, observer, or light source moves. Pattern is the relative size, arrangement, and contrast of bright and dark areas that result from internal and external reflections seen in a polished diamond when viewed face-up while that diamond is still or moving. As such, patterns can be seen as positive (balanced and cohesive patterns) or negative (e.g., fisheyes, dark centers, or irregular patterns).

Many of these pattern-related aspects of scintillation are already taken into consideration by experienced individuals in the diamond trade. Often they were included in the general assessments of diamonds we recorded during observation tests, usually described with terms such as dark spots or dead centers, in addition to fisheyes. Our main finding was that pattern-related effects were often used to describe why a diamond did not perform as well as it otherwise should based on its brightness and fire.

Many sparkle-related aspects of scintillation are already included in our brightness and fire metrics. These include specular reflections from facet surfaces (now included in the brightness metric) and the dispersed light that exits the crown but has not yet fully separated, so is not seen as separate colors at a realistic observer distance (included in the fire metric). We also found that sparkle was strongly tied to our fire metric, in that those diamonds that displayed high or low fire were found to display high or low sparkle, respectively. Therefore, we concluded that we did not need to address sparkle any further. However, we developed proportion-based limits and pattern calculations to specifically predict and assess the pattern-related aspects of scintillation.

Results: Brightness

In early observation experiments, we found that the WLR (weighted light return) metric of Hemphill et al. (1998), although an accurate predictor of a diamond's brightness when tested in an environment similar to the model, was not as effective at predicting the brightness observations by manufacturers and experienced trade observers in their own environments. Consequently, we developed a new brightness metric that included a more appropriate lighting condition, a more limited observer placement, and an additional observation factor (i.e., glare, that is, the direct reflections off the facet surfaces).

We first confirmed that observations with hemispheres agreed with our predictions of the relative order of the diamonds based on the corresponding brightness metrics. We then used the statistical techniques described in box A to determine which of these metrics gave the best fit to observations of brightness in dealer-equivalent environments (e.g., the GTI, Judge, and CVE). Cronbach alpha values for our brightness metric were determined to be 0.74 for observers alone, and 0.79 for observers plus our brightness metric; the closeness of the two values shows that the brightness metric is at least as reliable as the average observer.

Figure 5:
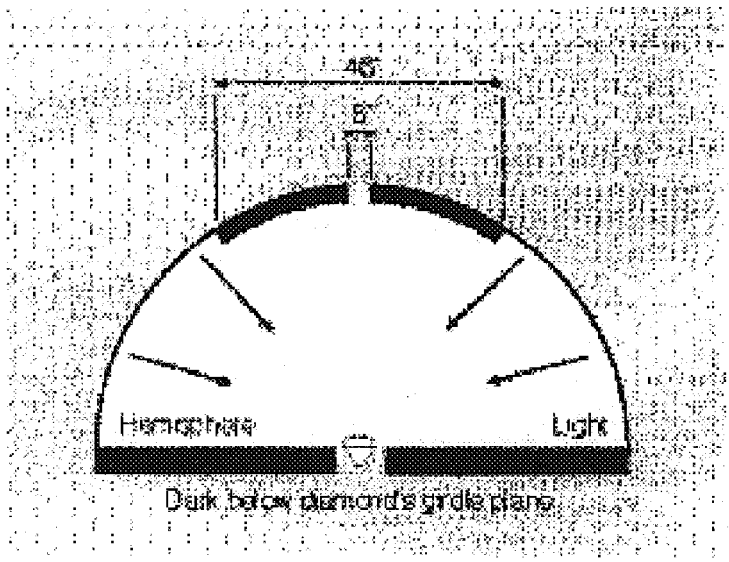
FIG. 5 is a schematic representation of the lighting conditions associated with the preferred brightness metric.

Our final brightness metric assumes a diffused, white hemisphere of light above the girdle plane of the diamond, with a dark circle located at the zenith of this hemisphere. FIG. 5 is a diagram which shows the environment and viewing conditions for our brightness metric. It assumes a diffused, white hemisphere of light above the girdle plane of the diamond, which a dark circle located at the zenith of this hemisphere that has a radius formed by a 23° angle from the centered normal of the diamond's table. The area below the girdle plane is dark. The total angular spread of observation is 3°, located directly over the center of the diamond's table. In addition, glare is included in the final metric results.

Results: Fire

Also as described above, the DCLR (dispersed colored light return) metric of Reinitz et al. (2001) did not correlate well with the collected fire observations in standard lighting and viewing conditions. This is probably because it assumed a greater ability to discern fire than observers demonstrated when they looked at diamonds instead of projected dispersed-light patterns (see Materials and Methods). Therefore, we varied the threshold for readily observable fire to find the best fit. Again using statistical methods mentioned in box A, we found that the best match to the observation data was for a threshold of $10^{1.25}$, which gives about 18 distinct levels of light intensity for observed fire.

Cronbach alpha values for our fire metric were determined to be 0.72 for observers alone, and 0.75 for observers plus our fire metric; again, the closeness of the two values shows that the fire metric is at least as reliable as the average observer. Since the final fire metric correlated well with the fire observation data, we did not vary any of the other model assumptions.

The Effect of Other Diamond Properties and Conditions on Brightness and Fire Our Brightness and Fire teams evaluated the brightness and fire of 688 diamonds with a range of colors, clarities, polish and symmetry grades, girdle condition (bruted, polished, or faceted), and blue fluorescence (less than 2% of all diamonds that fluoresce do so in colors other than blue) intensity (from none to strong), as given in the first column of table 2. From these evaluations, we assessed the interaction of these properties or conditions with apparent brightness and fire (by comparing the predicted metric values of these diamonds). We found, as would be expected, that apparent brightness decreases as the color of the diamond becomes more saturated in the GIA D-to-Z range (including browns). Grade-determining clouds in the SI2 and I clarity grades diminish the appearance of fire. Fair and Poor polish cause both apparent brightness and fire to diminish; and Fair or Poor symmetry negatively affects apparent brightness. Neither fluorescence nor girdle condition showed any effect on apparent brightness or fire. In addition, we determined that differences between brightness and fire metric results for our "perfectly" symmetrical virtual diamond and observations of brightness and fire in actual diamonds with varying symmetry characteristics were negligible.

Addressing Overall Cut Appearance

The next step was to compare brightness and fire metric results with observer assessments of overall appearance. For this exercise, we used the experienced observers who comprised our Overall observation team and a set of 937 diamonds borrowed from various sources. We also conducted observation tests with trade observers using the core reference set of Research Diamonds. Based on tests that placed diamonds into groups, these two observer populations distinguished five overall appearance levels. A number of additional results emerged:

(1) Differences in body color did not influence the ability of observers to assess overall cut appearance.

(2) To be ranked highest by the observers, a diamond had to have both high brightness and high fire metric values.

(3) Not all diamonds with high values for either or both metrics achieved the highest rank.

For the set of 937 Overall Verification Diamonds for which we had measurements, quality information, system predictions, and a detailed set of observations, the observer ranks for about 73% corresponded to the ranks that would be anticipated based on brightness and fire alone; most of the rest were ranked one level lower than would be expected solely based on those two metrics. An additional factor, perhaps more than one, was contributing to overall face-up appearance.

Results: Scintillation

At this point, we did not believe that developing a specific "scintillation metric" was the right approach. (Recall most of the sparkle aspect of scintillation was already being captured in our metrics for brightness and fire.) Instead, we needed to find a methodology for capturing and predicting the pattern-related effects of scintillation. We accomplished this using a dual system of proportion-based deductions and calculations for specific negative pattern-based features such as fisheyes. (For example, we downgraded diamonds with pavilion angles that were very shallow or very deep because these proportions generally changed the face-up appearance of the diamond in ways that made it less desirable to experienced trade observers.)

Based on the results of the OVD examinations, we found that some overall cut appearance categories were limited to broad, yet well-defined, ranges of proportions. Changes in table size, crown angle, crown height, pavilion angle, star length, lower-girdle length, culet size, girdle thickness, or total depth could lead to less desirable appearances, so that, based on our observation testing, we determined limits for each of these proportions for each of our overall cut quality categories. We also developed calculations to predict pattern-related effects of scintillation (based on proportion combinations) that included the fisheye effect, table reflection size, and localized dark areas in the crown when the diamond is viewed face-up (see Discussion section for examples). Additionally, we determined through our research that the tilting of the upper- and lower-girdle facets toward and away from each other in a manner different than used in standard round brilliant manufacturing (sometimes referred to in the diamond trade as "painting" and assessed by us using the diamond's inter-facet angles) could also cause detrimental pattern effects in the face-up appearance of the diamond. We therefore determined limits for painting values for each of our overall cut quality categories. A diamond has to score well on each of these pattern-related factors to achieve a high grade.

Design and Craftsmanship

After speaking with diamond manufacturers and retailers, we verified a number of additional aspects of a diamond's physical attributes as important: A diamond should not weigh more than its appearance warrants (i.e., diamonds that contain "hidden" weight in their girdles or look significantly smaller when viewed face-up than their carat weights would indicate); its proportions should not increase the risk of damage caused by its incorporation into jewelry and everyday wear (i.e., it should not have an extremely thin girdle); and it should demonstrate the care taken in its crafting, as shown by details of its finish (polish and symmetry). Diamonds that displayed lower qualities in these areas would receive a lower overall cut quality grade.

Putting it all Together

Each of these factors (brightness, fire, scintillation, weight ratio, durability, polish, and symmetry) individually can limit the overall cut quality grade, since the lowest grade from any one of them determines the highest overall cut quality grade possible. When taken together, these factors yield a better than 92% agreement between our grading system and Overall observation team results (for comparison, observers in our Overall observation team averaged a 93% agreement). Similar to our brightness and fire metrics, these results confirm that our grading system is as reliable as an average observer, and are considered a reliable measure of correlation in the human sciences; this is especially true in those studies influenced by preference (Keren, 1982). We found that many diamonds in the remaining percentage were often "borderline" cases in which they could be observed by our team as a certain grade one day, and as the bordering grade the next. The difficulties inherent in the assessment of cut for "borderline" samples are similar to those faced in the assessment of other quality characteristics. Observation testing with members of the retail trade and consumers confirmed these findings as well.

Grading Environment

When diamonds are being viewed for overall appearance, a standardized environment is essential. Therefore, we developed the GIA common viewing environment, which includes the diffused lighting used by manufacturers and dealers to assess the quality of a diamond's cut, and the directed lighting used by many retailers, within an enclosed neutral gray viewing booth. Our CVE contains a mix of fluorescent daylight-equivalent bulbs (to best display brightness) and LEDs (to best display fire). Observation tests and trade interaction confirmed that this environment is useful for consistently discerning differences in overall cut appearance.

After testing with laboratory observers who wore either white or black, we determined that observers provided more consistent results for assessing brightness (that is, independent observers were more likely to reach the same results) when they wore a white shirt. Shirt color did not influence fire and overall appearance observations.

During our observation testing with trade members and our Overall observation team, we also found that in many cases background color could affect the ease with which observers distinguished the face-up appearance of one diamond from another. We determined that white trays (which mimic the white folded cards and white display pads often used in the trade) can sometimes cause a diamond to look brighter by hiding or masking areas of light leakage (areas where light is not returned from the diamond because it exits out of the pavilion rather than back to the observer). Alternately, black trays were shown to demonstrate possible areas of light leakage, but in many cases they overemphasized them so the diamond looked too dark. We found that a neutral gray tray (similar in color to the walls of our CVE) was the most appropriate choice for assessing a round brilliant's overall face-up appearance.

Discussion

Through our research (computer modeling, observation testing, and trade interaction) we found that to be attractive, a diamond should be bright, fiery, sparkling, and have a pleasing overall appearance, especially as can be seen in the pattern of bright and dark areas when viewed face-up.

Aspects of overall face-up appearance seen as positive features include facet reflections of even, balanced size, with sufficient contrast between bright and dark areas of various sizes so that some minimal level of crispness (or sharpness) of the faceting is displayed in the face-up pattern. There are also appearance aspects that are considered negative traits: For example, a diamond should not display a fisheye or large dark areas in its pattern.

In the same manner, we recognized that more than just face-up attractiveness should be incorporated into evaluating overall diamond cut quality. Design and craftsmanship (as evidenced by a diamond's weight ratio, durability, polish, and symmetry), even if face-up appearance is barely affected, also should be evident in a diamond's fashioning.

Overall Cut Grade

Seven components (brightness, fire, scintillation, weight ratio, durability, polish, and symmetry) are considered together to arrive at an overall cut grade in the system of the preferred embodiment. These seven components are considered equally in the system, as the lowest result from any one component determines the final overall cut grade (e.g., a diamond that scores in the highest category for all components except durability, in which it scores in the second highest category, would only receive the second highest overall cut grade; see the pull-out chart for examples). Using this approach ensures that each diamond's overall cut grade reflects all critical factors, including aspects of face-up appearance, design, and craftsmanship.

In practice, a diamond cut grading system in accordance with the preferred embodiment operates by first establishing the diamond's light-performance potential through metric calculations of brightness and fire (i.e., the best grade possible considering the combination of average proportions and how well they work together to return white and colored light to the observer). That potential is then limited by pattern-, design-, and craftsmanship-related determinations based on calculations, proportion-range limits, and polish and symmetry, so that the grade takes into account any detrimental effects. These determinations work together with the brightness and fire metrics as a system of checks and balances; the cut grade of a diamond cannot be predicted by either the metric calculations or any of the other components alone.

We found through our observation tests that most experienced individuals can consistently discern five levels of overall cut appearance and quality. Thus, the preferred diamond cut grading system is composed of five overall grade categories.

Design and Craftsmanship

"Over-weight" diamonds are those with proportions that cause the diamond, when viewed face-up, to appear much smaller in diameter than its carat weight would indicate. Consider, for example, a 1 ct diamond that has proportions such that its diameter is roughly 6.5-6.6 mm; this diamond will have the face-up appearance of a relatively typical 1 ct round brilliant. A comparable 1 ct diamond with a diameter of, for example, only 5.7 mm should sell for less. A person who contemplates buying one of these diamonds might believe that the latter was a "bargain" (since both diamonds weigh 1 ct, but the latter costs less). However, that person would end up with a diamond that appeared smaller when viewed face-up because much of the weight would be "hidden" in the overall depth of the diamond. Such diamonds are described in the trade as "thick" or "heavy." A similar difference in value would apply if two diamonds had roughly the same diameter but one weighed significantly more.

Often, an assessment of a diamond as over-weight can be deduced from the combination of its crown height, pavilion depth, total depth, and/or girdle thickness. We developed a calculation that combines the effects of all these factors into one value (the weight ratio of a diamond). This ratio compares the weight and diameter of a round brilliant to a reference diamond of 1 ct with a 6.55 mm diameter, which would have a fairly standard set of proportions (see the pull-out chart for examples).

Durability is another trait of overall diamond cut quality that was emphasized throughout our interaction with members of the diamond trade. Diamonds fashioned in such a way that they are at greater risk of damage (i.e., those with extremely thin girdles) receive a lower grade in the preferred diamond cut grading system.

Finish (that is, the polish and physical symmetry of a diamond) also affects cut appearance and quality. Much like weight ratio and durability, polish and symmetry were highlighted by trade observers as important indicators of the care and craftsmanship that went into the fashioning of a diamond, and therefore important to consider in any comprehensive grading system. They are assessed based on standard GIA Gem Laboratory grading methodology, and lower qualities of either can bring the grade of the diamond down (again, see the pull-out chart for examples).

Other Diamond Quality Factors

Our observer tests enabled us to examine the effects of other diamond quality factors (e.g., color, clarity, fluorescence, and girdle condition) on overall cut appearance. Although in cases of very low color or clarity, we found some impact on overall appearance, in general observers were able to separate these factors out of their assessments. Therefore, we determined that the preferred diamond cut grading system does not need to take these factors into consideration in its final overall cut quality grades; it applies to all standard round brilliant cut diamonds, with all clarities, and across the D-to-Z color range as graded by the GIA Gem Laboratory.

Optical Symmetry

One aspect of pattern-related scintillation that has gained more attention in recent years is often called "optical symmetry" (see, e.g., Cowing, 2002; Holloway, 2004). Many people in the trade use this term for "branded" diamonds that show near-perfect eight-fold symmetry by displaying eight "arrows" in the face-up position (and eight "hearts" in table-down) when observed with specially designed viewers. To investigate the possible benefits of optical symmetry, we included several such diamonds in our observation testing. We found that although many (but not all) diamonds with distinct optical symmetry were rated highly by our observers, other diamonds (with very different proportions and, in many cases, no discernible optical symmetry) were ranked just as high. Therefore, both types of diamonds can receive high grades in our system.

The Preferred Diamond Cut Grading System

The preferred diamond cut grading system includes five categories relating to their proportions and other grade-determining factors. For the purposes of the below, categories are listed as "first" through "fifth," with "first" representing the best; although this nomenclature is provided herein for convenience only.

In the first category, there are a relatively wide range of proportions. For these three examples, brightness and fire metric values indicated that they could belong in the top category. Also, none of these diamonds were subject to downgrading based on proportion values or calculated pattern-related scintillation problems. Finally, these diamonds all had polish and symmetry grades that were Very Good or Excellent. These factors combined to create diamonds that would receive the highest grade.

Our research found that the top grade included even broader proportion ranges than are shown in the chart. For example, we have established that diamonds in this category could have crown angles ranging from roughly 32.0° to 36.0° and pavilion angles ranging from 40.6° to 41.8°. It is important to note, however, that not all proportions within these ranges guarantee a diamond that would rate a top grade. As we stated above, it is not any one proportion, but rather the interrelationship of all proportions, that determines whether a particular diamond will perform well enough to receive a top grade.

There are various reasons why particular diamonds would receive a lower cut grade in the preferred system. For example, a diamond may fall in the second category based on its fire metric and scintillation results, e.g., a total depth of 64.1% and crown height of 17.5%, and its weight ratio. This is a good example of a diamond where the proportion values cause lower light performance and a less-than-optimal face-up appearance.

We have found through our research that proportion ranges for the second category are much wider than those considered by other cut grading systems. Likewise, our trade observers were often surprised when they learned the proportions of diamonds they had ranked in this near-top-level category, although they supported our findings. Here, crown angles can range from roughly 27.0° to 38.0°, and pavilion angles can range from roughly 39.8° to 42.4°. Tables also can range from roughly 51% to 65% for this grade category. Once again, it is important to note that not all individual proportions within these ranges guarantee a diamond that would fall into the second category.

A further exemplary diamond may fall into the third category in the preferred diamond cut grading system for at least the following two reasons. First, it may have a crown height of 9.5% and a crown angle of 23.0°. These factors combine in this diamond to produce a shallow crown, which negatively affects overall appearance. In addition, this diamond is downgraded for a lack of contrast in its scintillation and a localized darkness in the crown area, which results from the interaction of the shallow crown with this particular pavilion angle. Therefore, this is a good example of a diamond that scores high on our brightness and fire metrics, yet is down-graded based on individual proportion values that cause undesirable pattern-related scintillation effects.

It is interesting to note, however, that many in the trade would not consider cutting a diamond with a crown angle this shallow. Yet our research has shown that diamonds with these proportions score in the middle category overall, and might be a very useful alternative for diamond cutters in some circumstances. Typical ranges for this grade category are roughly 23.0° to 39.0° for crown angles, 38.8° to 43.0° for pavilion angles, and 48% to 68% for table sizes.

An example of a diamond that would fall in the fourth category may have low brightness and fire metric scores, a table size of 70%, and downgrading for a fisheye that becomes more prominent when the diamond is slightly tilted. Here is another example of a "shallow" diamond, but this one is less attractive because of the fisheye produced by the combination of a large table and a shallow crown height (9.5%) with a pavilion angle of 40.2%.

An exemplary diamond that would receive the lowest grade may have brightness and fire metric results, and polish and symmetry grades (each was assessed as Good), that would place it in the second category, and a calculated prediction for localized darkness that would place it in the third category. However, it may fall into the fifth category in the preferred diamond cut grading system based on its total depth, e.g., 74.0% and its weight ratio, e.g., 1.52, that is 52% more "hidden" weight than a diamond with this diameter should have. Although these proportions may seem extreme, this diamond was purchased in the marketplace. This diamond might be considered better in a less comprehensive system that only accounted for brightness, fire, and finish; however, we believe that this diamond's overall cut quality (which includes its excess weight) is properly accounted for and appropriately graded in our system.

Personal Preferences and their Effect on Diamond Grading

Although a diamond's performance is quantifiable, "beauty" remains subjective. (That is, metrics are not subjective but individual taste is.) No cut system can guarantee that everyone will prefer one set of proportions over another; instead, as you move down the cut grade scale, the diamonds in the grade categories change from those that almost everyone likes, to those that only some people might like, to those that no one prefers. A grading system that fails to acknowledge differences in taste is neither practical nor honest in terms of human individuality and preference.

We have found through our research and extensive interaction with the trade that even for diamonds within the same grade, some individuals will prefer one face-up appearance over another. Individual preferences have even greater impact in the lower categories. The inherent role of personal preference in diamond assessment will often lead to a situation in which some observers will not agree with the majority; thus, no cut grading system should expect to assess perceived diamond cut quality perfectly for everyone. Instead, what we have tried to accomplish with our grading system is to "capture" within each grade category those diamonds that, in general, most individuals would consider better in appearance and cut quality than diamonds in the next lower category.

EXAMPLE IMPLEMENTATION

Figure 7:
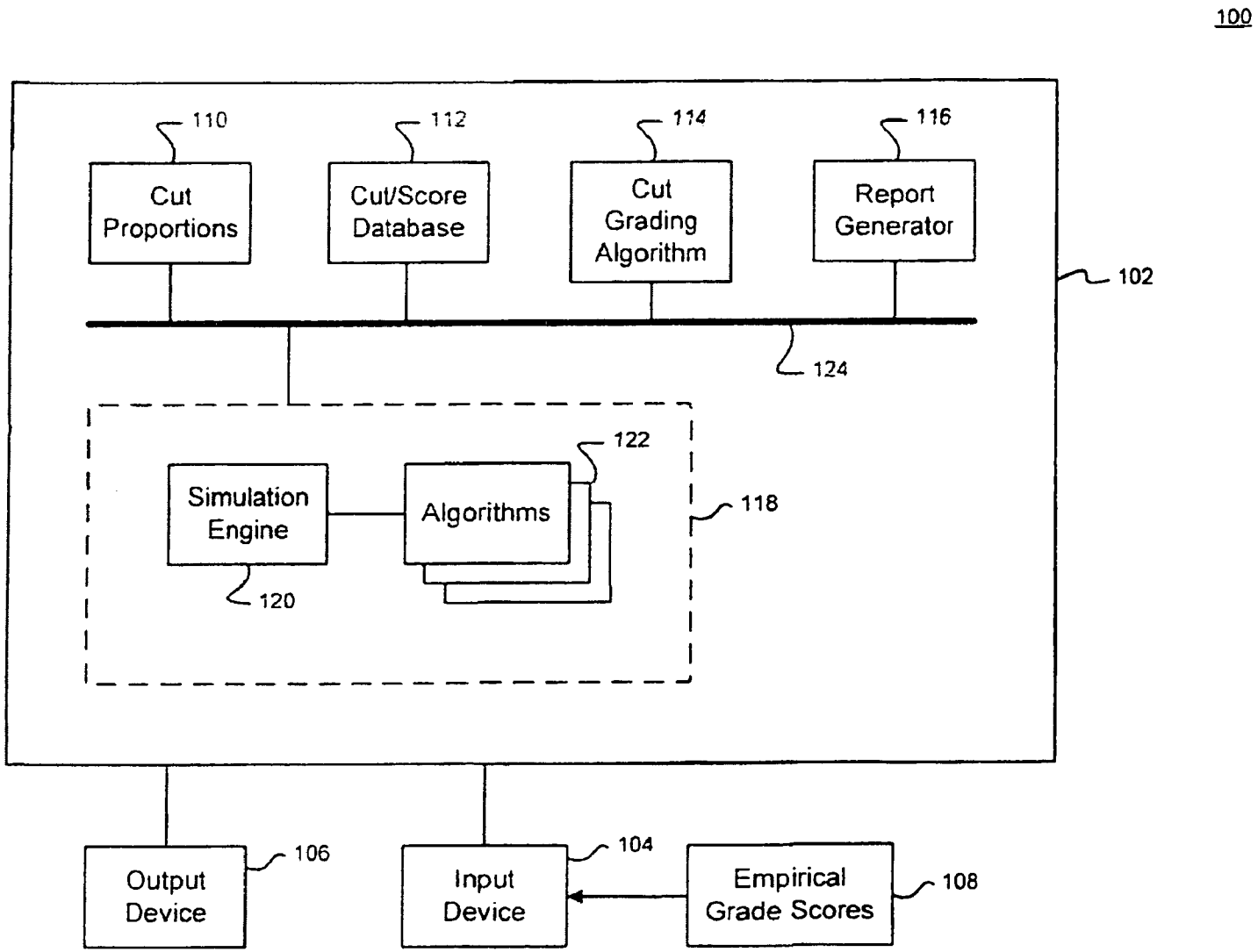
FIG. 7 is a schematic representation of a computer-implemented embodiment of a gemstone cut grading system.

FIG. 7 is a schematic representation of a computer-implemented embodiment of a gemstone cut grading system 100 according to the invention. For ease of illustration, cut grading system 100 represents a simplified architecture; a practical architecture may have additional and/or alternative physical and logical elements. In this regard, cut grading system 100 can be deployed in a conventional computing device, system, or architecture such as a computer 102 (for the sake of clarity, conventional elements of the computer 102 are not shown or described in connection with cut grading system 100).

Computer 102 may include and/or communicate with at least one input device 104 and at least one output device 106. Input device 104 is configured to enter, accept, read, or otherwise receive data or information utilized by cut grading system 100. In the practical embodiment, input device 104 receives empirical grade scores 108 for gemstones under test and/or cut proportion data for gemstones (or simulated gemstone representations) under test. The empirical grade scores 108 may be entered by a user via a keyboard or other user interface, received in an electronic format by a data reading device, scanned by input device 104, or the like. In this regard, input device 104 is one example of a means for receiving cut proportions for gemstone representations. Output device 106 is configured to generate a suitable output for use by the user of cut grading system 100. In this regard, output device 106 may be a display terminal, a printing device, a memory storage device, or the like. In one practical embodiment, output device 106 is a printer configured to generate cut grade reports for the gemstones under test.

Cut grading system 100 includes, maintains, accesses, or communicates with the following features, each of which may be realized as an operating element, a database, a processing component, a software module, firmware, or the like: cut proportions 110; a cut/score database 112; a cut grading algorithm 114; a report generator 116; and an optional modeling architecture 118 (which may include a simulation engine 120 and a number of cut-related metrics, algorithms, and/or calculations 122). For illustrative purposes, these features are depicted as being interconnected via a communication bus 124. These features are described in more detail below in connection with the various processes and methods performed by or in connection with cut grading system 100.

Figure 8:
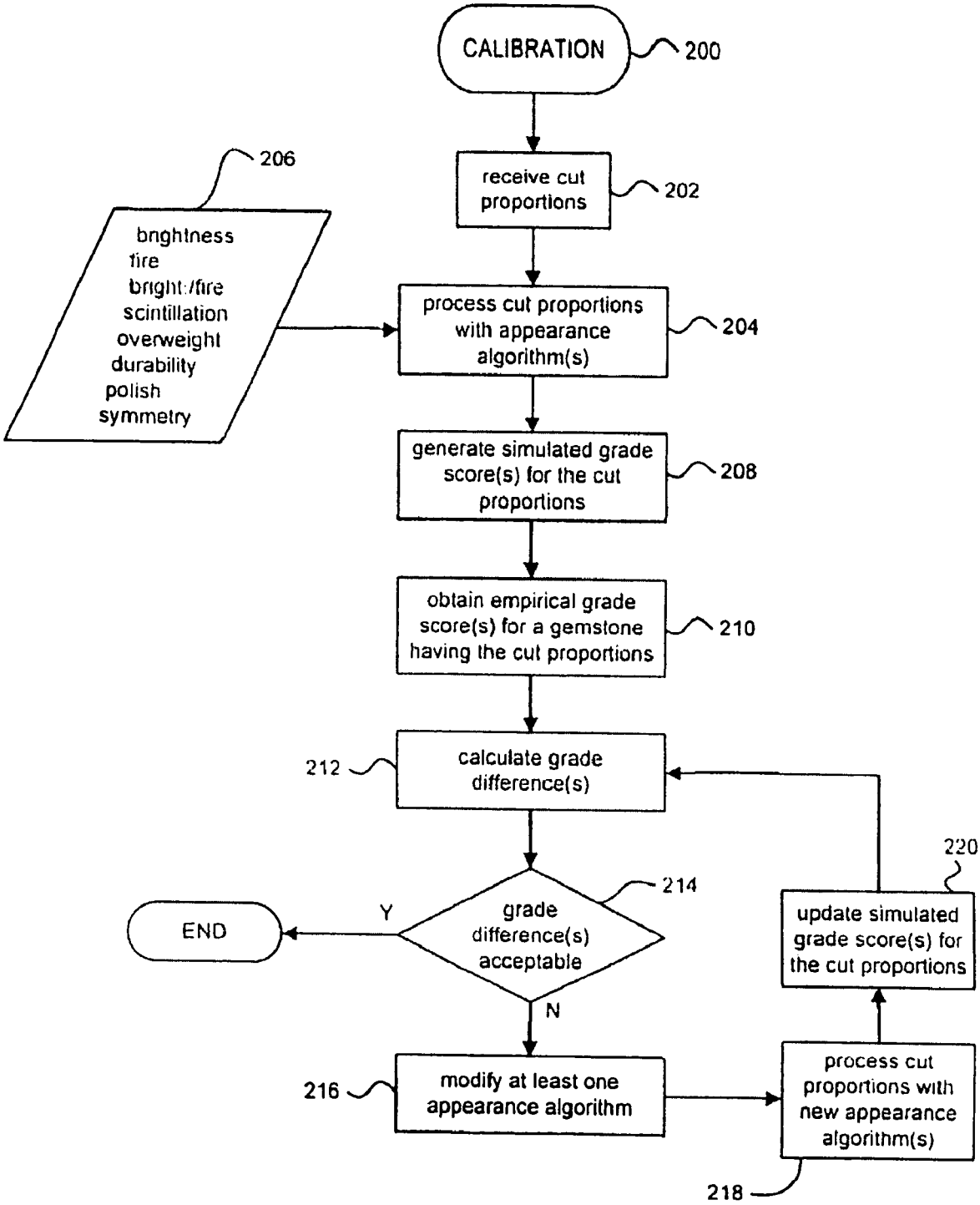
FIG. 8 is a flow chart of a calibration process that may be carried out in connection with a gemstone cut grading system.

FIG. 8 is a flow chart of a calibration process 200 that may be carried out in connection with cut grading system 100. Calibration process 200 is performed to calibrate cut grading system 100 such that its output correlates to empirical observation testing (as described in detail above). Calibration process 200 assumes that cut grading system 100 leverages one or more initial appearance metrics that can be used to calculate grades, scores, or simulations for one or more respective appearance characteristics based on the cut proportions of the diamond. Accordingly, calibration process 200 may begin by receiving cut proportions for a gemstone representation (task 202). Referring to FIG. 7, cut proportions 110 may be received by input device 104 or other means, then stored in a suitable memory location in computer 102. In this regard, input device 104, the software or computer program element(s) responsible for maintaining cut proportions 110, and the memory that stores the cut proportion data are examples of means for receiving cut proportions for gemstone representations. The cut proportions may include, without limitation, any number of the following: crown angle; crown height; pavilion angle; pavilion depth; table size; total depth; star facet size; lower girdle facet size; girdle thickness; culet size; and painting values.

The cut proportions are then processed with a number of appearance algorithms (task 204) to generate simulated grade score(s) for the gemstone representation and the current set of cut proportions (task 208). The appearance algorithms (identified by reference number 122 in FIG. 7 and by reference number 206 in FIG. 8) may include, without limitation, algorithms for any number of the following: a brightness characteristic; a fire characteristic; a combined brightness/fire characteristic; a scintillation characteristic; a weight ratio characteristic; a durability characteristic; a polish characteristic; and a symmetry characteristic. Although only brightness and fire metrics were described in detail above, the invention is not so limited. The computer may include a simulation engine 120 that, in conjunction with the algorithms 122, simulates appearance characteristics of the gemstone representation or otherwise executes the algorithms 122. The simulated grade score(s) may be a single overall grade score or a plurality of individual grade scores for respective cut components (e.g., brightness, fire, scintillation-sparkle, scintillation-pattern, overweight, durability, polish, or finish).

In addition to the simulated grade score(s), calibration process 200 obtains at least one empirical grade score (task 210) for a gemstone having the cut proportions received during task 202. In practice, the actual cut proportions of the gemstone may fall within a suitable tolerance range, i.e., the actual cut proportions need not be precisely identical to the virtual cut proportions. As mentioned above, empirical grade scores are obtained from human observers (the observers may be skilled gemologists, gem traders, and/or persons unfamiliar with gemstones). Any given empirical grade score can be based on any number of observations made by any number of persons. For example, the empirical grade score for the cut component of polish may be from a single observation that results in a grade of three. Alternatively, such a grade score may be an average score of a plurality of observations.

The empirical grade scores are employed as a means to adjust the appearance algorithms if necessary. This procedure, which is described in detail above for the brightness and fire metrics, can be used for any of the algorithms associated with the cut grading system. In the example embodiment, the simulated grade score and the corresponding empirical grade score for a given cut component are based on a common grading scale. For example, the simulated and empirical grade scores for brightness may be based on a grading scale of 1 to 5, with 1 being the best grade and 5 being the worst grade. Eventually, calibration process 200 calculates grade difference(s) between the empirical grade scores and the respective simulated grade scores (task 212). This difference represents the accuracy of the cut grading system relative to actual observations. Task 212 may calculate any number of grade differences corresponding to any number of individual cut components and/or an overall cut grade score. If the grade differences are acceptable (query task 214), then calibration process 200 ends and the cut grading system can be deployed with a certain confidence level.

If the grade differences are not acceptable, then calibration process 200 continues by modifying at least one appearance algorithm (task 216). Such modification is responsive to the grade differences in that the modification strives to reduce the grade differences in the next iteration. The specific manner in which the algorithms are modified will vary according to the particular algorithm, the amount of the grade differences, and the desired tolerance. After modifying at least one algorithm, the cut proportions are again processed, using the modified set of appearance algorithms (task 218). This processing results in an updating of the simulated grade scores for the given cut proportions (task 220). Thereafter, calibration process 200 can be re-entered at task 212. In this manner, process 200 strives to optimize the set of appearance algorithms.

Figure 9:
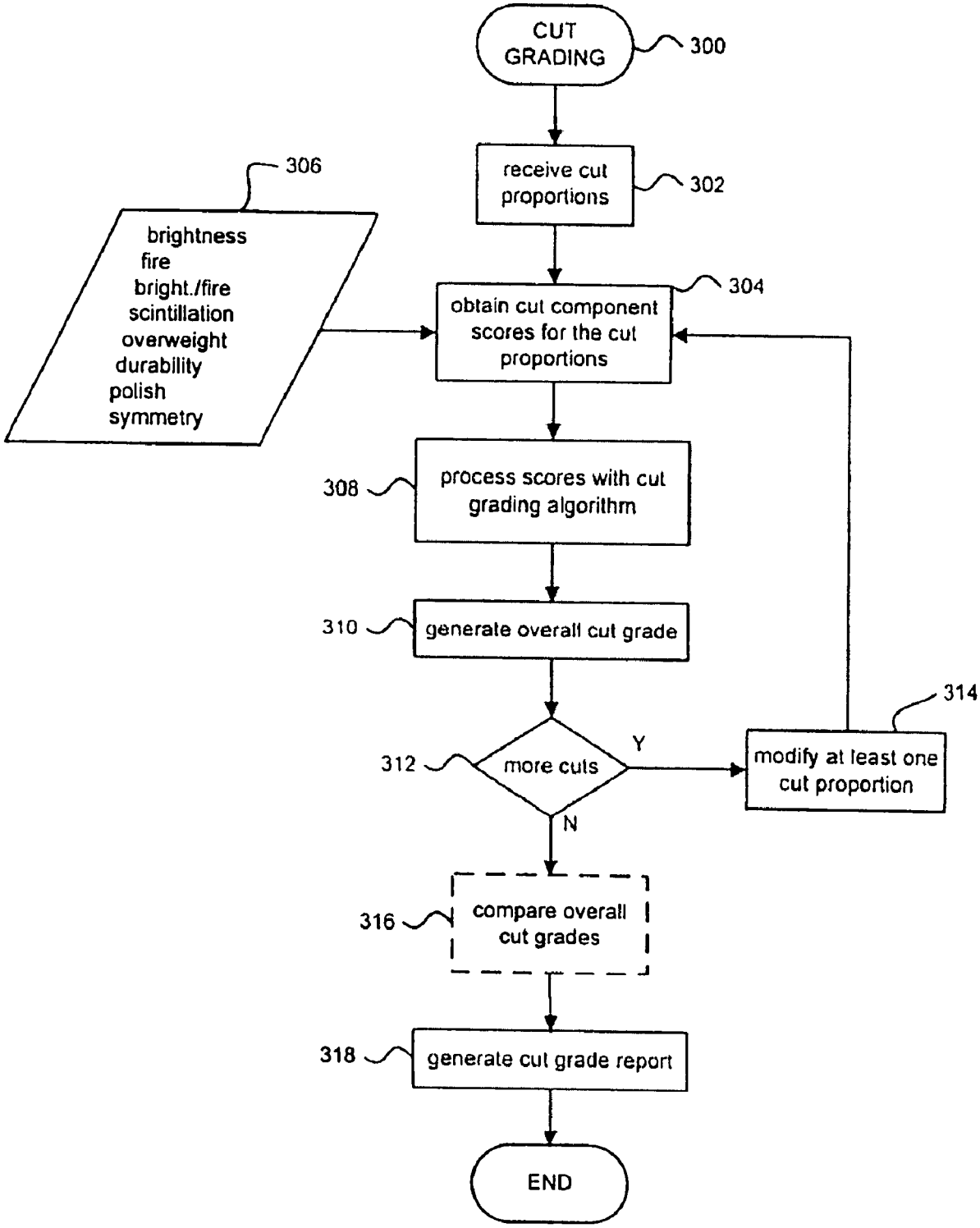
FIG. 9 is a flow chart of a gemstone cut grading process according to a preferred embodiment of the invention.

FIG. 9 is a flow chart of a gemstone cut grading process 300 according to the invention. Although the practical embodiment of the cut grading system is at least partially computerized, the invention and process 300 is not so limited. Process 300 begins by receiving cut proportions for a gemstone representation (task 302), where the gemstone representation may be a "real world" cut gemstone, a virtual gemstone, and/or a computer-representation of a gemstone. The cut proportions may include, without limitation, any number of the following: crown angle; crown height; pavilion angle; pavilion depth; table size; total depth; star facet length; lower girdle facet length; girdle thickness; culet size; and painting values. In response to the cut proportions, process 300 obtains a number of scores (task 304) for a plurality of cut components 306 corresponding to the gemstone representation. Each of the cut components affects the cut quality of the gemstone representation, and at least one of the cut component scores is derived from the cut proportions. For example, the score for brightness represents the brightness component of cut quality, where low brightness generally indicates lesser quality and high brightness generally indicates better quality.

The scores may be simulated, computer-generated, or obtained in response to human observation. For example, task 304 may obtain scores derived from at least one appearance algorithm (such as a brightness metric, a fire metric, and/or a scintillation calculation), scores derived from at least one physical algorithm (such as an overweight assessment and/or a durability determination), and/or scores derived from at least one craftsmanship determination (such as a polish determination and/or a symmetry determination). In this regard, the various algorithms 122, the simulation engine 120, and the respective software elements are examples of means for obtaining scores for the cut components (see FIG. 7). In the example embodiment, each of the scores is based on a common grading scale. For example, each cut component score can be an integer between 1 and 5, where 1 is the best score and 5 is the worst score. In this regard, a practical embodiment of cut grading process 300 might obtain eight scores (one for each cut component 306) ranging from 1 to 5.

Cut grading process 300 processes the scores with a suitable cut grading algorithm (task 308) to generate an overall cut grade for the gemstone representation (task 310). This algorithm 114 is schematically depicted in FIG. 7. In this regard, the cut grading algorithm and the software elements that carry out the algorithm are examples of a means for generating the overall cut grade. The algorithm is configured such that the overall cut grade provides a fair and reasonable indication of the quality of the cut. The example embodiment employs a relatively straightforward algorithm that produces a single overall grade rather than a "grade" that includes a plurality of components. In practice, the algorithm selects the worst of the individual scores for use as the overall cut grade. For example, assume that a gemstone representation obtains the following scores for the cut components: brightness=1; fire=2; combined brightness/fire=2; scintillation=3; overweight=1; durability=2; polish=1; symmetry=2. For this particular sample, the overall cut grade would be the worst score, or 3.

The cut grading system may be configured to accommodate "side by side" comparisons of different gemstone representations. Accordingly, if more cuts are to be graded (query task 312), then cut grading process 300 modifies at least one cut proportion (task 314) to obtain the next gemstone representation. Task 314 may be performed automatically and/or in response to user input. Following task 314, task 304 is re-entered to obtain the overall cut grade for the new gemstone representation. If no additional cuts remain, then an optional task 316 can be performed. Task 316 compares the overall cut grades of the various gemstone representations. Task 316 may simply compare the actual numerical scores or, in a computer-implemented embodiment, display the gemstone representations along with their simulated appearances.

Cut grading process 300 preferably generates a grade report (task 318) that identifies at least the overall cut grade score for the gemstone representation(s). In practice, the report can be created by a computer-implemented report generator 116 (see FIG. 7). The report can be an electronic report and/or a physical report. In the practical embodiment, the report contains a diagram of the gemstone representation, a listing or identification of the cut proportions, the overall cut grade score, the carat weight, and possibly other identifying data. In FIG. 7, the output device 106, which may be a computer monitor, a printer device, a facsimile device, or the like, may be configured to generate the grade report.

Figure 10:
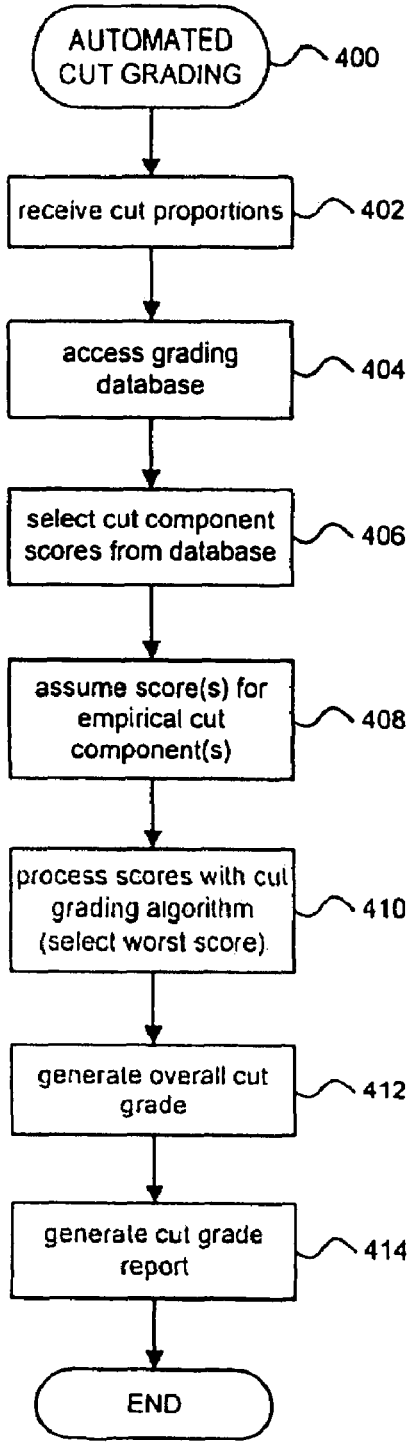
FIG. 10 is a flow chart of an automated gemstone cut grading process according to a preferred embodiment of the invention.

Although the cut grading system can include subjective human grading elements, one practical embodiment of the invention is fully automated and computer-implemented. Indeed, FIG. 7 depicts a computerized version of cut grading system 100 that is capable of performing an automated cut grading process. In this regard, FIG. 10 is a flow chart of an automated gemstone cut grading process 400 according to a preferred embodiment of the invention.

Automated cut grading process 400 begins by receiving cut proportions for a gemstone representation (task 402), where the gemstone representation may be a "real world" cut gemstone, a simulated gemstone, and/or a computerized representation of a gemstone. The cut proportions may include, without limitation, any number of the following: crown angle; crown height; pavilion angle; pavilion depth; table size; total depth; star facet length; lower girdle facet length; girdle thickness; culet size; and painting values. In response to the cut proportions, process 400 obtains a number of cut component scores for the gemstone representation. The obtained scores are preferably calculated with or otherwise derived from metrics, algorithms, calculations, or determinations that provide scores for at least one of the following aspects: brightness, fire, a combined brightness/fire characteristic, scintillation, overweight, durability, polish, and symmetry.

In accordance with one practical embodiment, the brightness, fire, and combined brightness/fire metrics are each based at least in part on a predictive ray tracing calculation. Such calculations and modeling are described above and example brightness and fire metrics are described in the Hemphill et al. and Reinitz et al. articles cited above. The scintillation, overweight, and durability calculations are each based at least in part on one or more of the cut proportions. In other words, scores for these cut components can be calculated from the cut proportions without having to perform ray tracing. In the example embodiment, the polish and symmetry determinations are each based at least in part on human observation.

Automated cut grading process 400 preferably obtains cut component scores that have been "pre-calculated" for the given cut proportions. In particular, process 400 may access a grading database (task 404) that contains cut component scores for sample gemstone representations having different sample cut proportions, and select (from that database) cut component scores for sample cut proportions corresponding to the currently entered cut proportions (task 406). In FIG. 7, cut/score database 112 is the grading database, and cut proportions 110 represents the currently entered set of proportions that are used to query database 112. Notably, database 112 can be populated with empirical and/or virtual cut grade scores for any number of cut proportions. The database 112 is preferably populated with a very large and comprehensive number of gemstone representations such that any realistic set of cut proportions (received during task 402) will have corresponding cut component scores in database 112. The use of database 112 obviates the need to run the complex and calculation-intensive ray tracing algorithms in real time. Rather, the cut grading system can conveniently perform a table look-up operation to access and extract the relevant cut component scores. If database 112 is complete and comprehensive, then task 406 can select scores for sample cut proportions that match the received set of cut proportions. Otherwise, task 406 may select scores for sample cut proportions that are merely similar to the received set of cut proportions. Alternatively, if an identical match cannot be made, then process 500 may generate a suitable error message or report. Therefore, database 112 and the software elements that govern the accessing of database 112 are examples of means for obtaining scores for the cut components.

As mentioned previously, the polish and symmetry cut components are usually graded by human observers. Accordingly, scores for these (and other empirical cut components) can be assumed (task 408) by the cut grading system. Alternatively, these scores can be received via a suitable input device (see FIG. 7). In a practical embodiment, automated cut grading process 400 assumes that the polish and symmetry for all gemstone representations are "Good"—this assumption eliminates the need for human observation.

As described above, each of the scores may be based on a common grading scale. For example, each cut component score can be an integer between 1 and 5, where 1 is the best score and 5 is the worst score. Automated cut grading process 400 processes the scores with a suitable cut grading algorithm (task 410) to generate an overall cut grade for the gemstone representation (task 412). Again, the example algorithm selects the worst of the scores for use as the overall cut grade.

Automated cut grading process 400 can also generate a grade report (task 414) that identifies at least the overall cut grade score for the gemstone representation. The report can be an electronic report displayed at the computer monitor, and/or a hard copy report printed by a printer device connected to the computer. As described above in connection with cut grading process 300, the automated cut grading system may be configured to accommodate "side by side" comparisons of different gemstone representations.

CONCLUSIONS

During the research into the relationship of proportions and overall cut quality, we have accomplished a great deal including the following:

(1) we have developed a computer model and created metrics to predict brightness and fire;

(2) we have developed a methodology to validate those metrics and assess other aspects of cut appearance and quality using observation testing;

(3) we have created a common "standardized" viewing environment; and, finally, combined all of these elements to create a comprehensive system for grading the cut appearance and quality of round brilliant diamonds.

In the course of this research (including research described in our earlier articles, Hemphill et al., 1998, and Reinitz et al., 2001), we arrived at many conclusions. Among them:

(1) Proportions need to be considered in an interrelated manner. The combination of proportions is more important than any individual proportion value.

(2) Attractive diamonds can be manufactured in a wider range of proportions than would be suggested by historical practice or traditional trade perception.

(3) For consistent comparisons between diamonds, cut grading requires a standardized viewing environment that is representative of common environments used by the trade.

(4) Personal preferences still matter. Diamonds with different appearances can be found within each cut grade, so individuals need to look at the diamond itself, not just its grade, to choose the one they like the best.

Our research and trade interaction also necessitated the further refinement of the terms we use to describe the appearance of a polished diamond when it is viewed face-up. Among these definitions are those provided above for Brightness, Fire and Scintillation.

The Preferred Diamond Cut Grading System

We determined that to best serve the public and the trade, an effective diamond cut grading system should ensure that well-made diamonds receive the recognition they deserve for their design, craftsmanship, and execution. Conversely, it should ensure that diamonds that are not pleasing in appearance, or that warrant a discount for weight or durability reasons, are rated appropriately. In addition, this system should take into consideration personal and global differences in taste.

Extensive observation testing and trade interaction made it very clear that for a diamond cut grading system to be useful and comprehensive, it had to consider more than just brightness, fire, and scintillation (i.e., more than only face-up appearance). For these reasons, we decided that our system should also include elements of design and craftsmanship (which can be seen in a diamond's physical shape and finish respectively). Therefore, the preferred diamond cut grading system, which applies to standard round brilliant diamonds on the GIA D-to-Z color scale, encompasses the following seven components: brightness, fire, scintillation, weight ratio, durability, polish, and symmetry.

Brightness and fire, including aspects of sparkle-related scintillation, are assessed using computer-modeled calculations that have been refined and validated by human observations. Pattern-related aspects of scintillation are assessed using a combination of determinations based on proportion ranges, painting values, and calculations developed to predict specific detrimental patterns (both derived from observation testing). Weight ratio (which is used to determine whether a diamond is so deep that its face-up diameter is smaller than its carat weight would usually indicate) and durability (in the form of extremely thin girdles that put the diamond at a greater risk of damage) are calculated from the proportions of each diamond. Polish and symmetry are assessed using standard GIA Gem Laboratory methodology. The grading scale for each of these components was validated through human observations; these individual grades are considered equally when determining an overall cut grade.

In summary, our research has led us to conclude that there are many different proportion sets that provide top-grade diamonds, and even wider ranges of proportions that are capable of providing pleasing upper-middle to middle-grade diamonds. Although it is important to consider many components when assessing the overall cut appearance and quality of a round brilliant diamond, an individual's personal preference cannot be ignored. The preferred cut grading system provides a useful assessment of a diamond's overall cut quality, but only individuals can tell you which particular appearance they prefer. With this system of cut grading, the diamond industry and consumers can now use cut along with color, clarity, and carat weight to help them make balanced and informed decisions when assessing and purchasing round brilliant diamonds.

Diamond Cut Grading Reference System

During our research and trade interaction, it became clear that for our grading system to be useful to all levels of the diamond trade (including manufacturers, dealers, retailers, and appraisers), as well as consumers, we needed to provide a method for individuals to predict the cut grade of a polished diamond (even if that diamond was only in the "planning" stage of fashioning) from that diamond's proportion parameters. To this end, we have developed reference software.

This software provides a predicted overall cut grade from proportion values input by the user, with different versions allowing variation of some or all relevant proportions. Final results are in the form of an estimated overall cut grade by itself (in the basic version of the application) or the estimated overall cut grade presented within a larger grid that would allow a user to explore possible alternative proportion sets that might provide an improved final result.

Although a primary goal of this research project has been to develop a cut grading system for round brilliant diamonds, there are other benefits that we have gained from this work. Perhaps most importantly, this research project has allowed us to create and validate a method of modeling the behavior of light in a polished diamond along with a methodology to verify the findings from that modeling using observation testing by experts in the field. We can now apply these technologies and methods to other shapes, cutting styles, and colors of diamond to determine whether similar grading systems can be developed. We will continue to identify new goals and questions related to diamond cut as we move forward in our research, beyond the standard round brilliant.

REFERENCES

The following are hereby incorporated by reference:

Computer used to set standard of gem beauty (1978) Retail Jeweler, January 19, p. 40.

Cowing M., Yantzer P., Tivol T. (2002) Hypothesis or practicality: The quest for the ideal cut. New York Diamonds, Vol. 71, July, pp. 40, 42, 44.

Cronbach, L. J. (1951) Coefficient alpha and the internal structure of the tests. Psychometrika, Vol. 16, pp. 297-334.

Dodson J. S. (1978) A statistical assessment of brilliance and fire for polished gem diamond on the basis of geometrical optics. Optica Acta, Vol. 25, No. 8, pp. 681-692.

Dodson J. S. (1979) The statistical brilliance, sparkliness, and fire of the round brilliant-cut diamond. Diamond Research 1979, pp. 13-17.

Fey E. (1975) Unpublished research completed for GIA.

GIA Diamond Dictionary, 3rd ed. (1993) Gemological Institute of America, Santa Monica, Calif., 275 pp.

Harding B. (1986) GemRay [unpublished computer program].

Hardy A., Shtrikman S., Stern N. (1981) A ray tracing study of gem quality. Optica Acta, Vol. 28, No 6, pp. 801-809.

Hemphill T. S., Reinitz I. M., Johnson M. L., Shigley J. E. (1998) Modeling the appearance of the round brilliant cut diamond: An analysis of brilliance. Gems & Gemology, Vol. 34, No. 3, pp. 158-183.

Holloway G. (2004) The Ideal-Scope. Precious Metals, http://www.preciousmetals.com.au/ideal-scope.asp [date accessed: Jun. 22, 2004].

Inoue K. (1999) Quantification and visualization of diamond brilliancy. Journal of the Gemmological Society of Japan, Vol. 20, No. 1-4, pp. 153-167.

Keren G., Ed. (1982) Statistical and Methodological Issues in Psychology and Social Sciences Research. L. Erlbaum Associates, Hillsdale, N.J., 390 pp.

Kiess H. O. (1996) Statistical Concepts for the Behavioral Sciences. Allyn and Bacon, Boston, 604 pp.

King J. M., Moses T. M., Shigley J. E., Liu Y. (1994) Color grading of colored diamonds in the GIA Gem Trade Laboratory. Gems & Gemology, Vol. 30, No. 4, pp. 220-242.

Lane D. M. (2003) Pearson's correlation (1 of 3). Hyperstat Online, http://davidmlane.com/hyperstat/A34739.html [date accessed Aug. 23, 2004].

Lawless H., Chapman K., Lubran M., Yang H. (2003) FS410: Sensory evaluation of food. Cornell University, Fall, http://zingerone.foodsci.cornell.edu/fs410 [date accessed: Sep. 11, 2003].

Lenzen G. (1983) Diamonds and Diamond Grading. Butterworths, London, p. 164.

Long R., Steele N. (1988) Ray tracing experiment with round brilliant. Seattle Faceter Design Notes, January.

Long R., Steele N. (1999) United States Faceters Guild Newsletter, Vol. 9, No. 4.

Manson D. V. (1991) Proportion considerations in round brilliant diamonds. In A. S. Keller, Ed., Proceedings of the International Gemological Symposium 1991, Gemological Institute of America, Santa Monica, Calif., p. 60.

Moses T. M., Reinitz I. M., Johnson M. L., King J. M., Shigley J. E. (1997) A contribution to understanding the effect of blue fluorescence on the appearance of diamonds. Gems & Gemology, Vol. 33, No. 4, pp. 244-259.

Nunnally J. C. (1994) Psychometric Theory, 3rd ed. McGraw-Hill, New York, 752 pp.

Ohr L. M. (2001). Formulating with sense. Prepared Foods, February; http://www.preparedfoods.com/CDA/ArticleInformation/features/BNP_Features_Item/0,1231,114431,00.html [date accessed: Aug. 23, 2004]

Reinitz I. M., Johnson M. L., Hemphill T. S., Gilbertson A. M., Geurts R. H., Green B. D., Shigley J. E. (2001) Modeling the appearance of the round brilliant cut diamond: An analysis of fire, and more about brilliance. Gems & Gemology, Vol. 37, No. 3, pp. 174-197.

Shannon P., Wilson S. (1999) The great cut debate rages on. Rapaport Diamond Report, Vol. 22, No. 5 (February 5), pp. 89-90, 95.

Shigetomi G. T. (1997) Diamond industry breakthrough. Bangkok Gems & Jewellery, Vol. 10, No. 8, pp. 97, 98, 100.

Shipley R. M. (1948, date approximate) Assignment 2-30: The critical angle and comparative brilliancy. Diamonds Course, Gemological Institute of America, Los Angeles, p. 1.

Sivovolenko et al. (1999) http://www.gemology.ru/cut/english/document4.htm [date accessed: Dec. 15, 2003].

Strickland R. (1993) GEMCAD™ [computer program]. Austin, Tex.

Tognoni C. (1990) An automatic procedure for computing the optimum cut proportions of gems. La Gemmologia, Vol. 25, No. 3-4, pp. 23-32.

van Zanten P. G. (1987) Finding angles for optimal brilliance by calculation. Seattle Faceter Design Notes, November.

Yu C. H. (1998) Using SAS for item analysis and test construction, http://seamonkey.ed.asu.edu/~alex/teaching/assessment/alpha.html [dated accessed Aug. 23, 2004].

Yu C. H. (2001) An introduction to computing and interpreting Cronbach Coefficient Alpha in SAS. In Proceedings of the 26th SAS Users Group International, Apr. 22-25, 2001, Long Beach, Calif., Paper 246-26, http://www2.sas.com/proceedings/sugi26/p246-26.pdf [date accessed Aug. 23, 2004].

The present invention has been described above with reference to a preferred embodiment. However, those skilled in the art having read this disclosure will recognize that changes and modifications may be made to the preferred embodiment without departing from the scope of the present invention. These and other changes or modifications are intended to be included within the scope of the present invention, as expressed in the following claims, and structural and functional equivalents thereof.

Moreover, in methods that may be performed according to the invention and/or preferred or alternative embodiments herein and that may have been described above and/or recited below, the operations have been set forth in selected typographical sequences. However, the sequences have been selected and so ordered for typographical convenience and are not intended to imply any particular order for performing the operations, except for those where a particular order may be expressly set forth or where those of ordinary skill in the art may deem a particular order to be necessary. Moreover, as it is preferred that program instructions are embedded within one or more optical, magnetic or other storage device for providing instructions to processor-based electronic, optical, mechanical, digital or other systems and equipment for performing the preferred and alternative methods of the invention, further peripheral equipment may be provided in combination therewith. For example, output devices such as viewing screens, printers, email or otherwise may be included for printing scores including outputting scores to a variety of digital, optical or other designated locations. A wire frame is preferably also provided for each diamond. These wire frames are preferably created from the proportions of each diamond.

What is claimed is:

1. A method for grading the cut of a physical or virtual gemstone, comprising receiving cut proportions for the gemstone;

obtaining scores for a plurality of cut score components, including accessing prediction tables from which scores for designated ones of the plurality of cut score components can be obtained, and in which each of the designated cut score components has an associated range of possible scores, wherein, for a particular designated cut score component, the possible scores are associated with corresponding ranges of cut proportions, and the corresponding ranges are based upon theoretically derived scores combined with empirically derived boundaries or thresholds, wherein the theoretically derived scores have been determined for possible cut proportions for the particular designated cut score component, and the boundaries or thresholds have been set by statistical analysis of observations of the particular designated cut score component;

applying the received cut proportions to the accessed prediction tables to obtain corresponding scores for the designated cut score components; and outputting the cut grade reports for the gemstone.

2. The method of claim 1, wherein a common grading scale is utilized in each associated range of possible scores for the plurality of cut score components.

3. The method of claim 1, wherein the boundaries or thresholds are defined using mathematical formulae based on empirical observations.

4. The method of claim 1, further comprising providing an overall cut grade for the physical or virtual gemstone that is determined by the worst of the scores obtained for the plurality of cut score components for the physical or virtual gemstone.

5. The method of claim 4, wherein the gemstone is a virtual gemstone, and further comprising receiving an modified set of cut proportions for the virtual gemstone;

obtaining a comparison set of scores for the plurality of cut score components based upon the modified set of cut proportions;

providing an overall cut grade for the virtual gemstone that is determined by the worst of the scores of the comparison set of scores;

comparing the overall cut grades for the received cut proportions and the modified set of cut proportions.

6. The method of claim 1, wherein the correspondence between the cut proportion ranges and the associated possible scores for at least one of the cut score components are determined by processing the cut proportions with a number of appearance-based algorithms, each appearance-based algorithm based on statistical analysis of observations.

7. The method of claim 1, wherein the obtaining scores for cut score component includes obtaining scores based upon subjective observations of polish, symmetry, culet or girdle thickness of a physical gemstone, and the method further includes providing an overall cut grade for the physical gemstone that is determined by the worst of the scores obtained for the plurality of cut score components.

8. The method of claim 1, wherein the plurality of cut score components include one or more of a brightness characteristic, a fire characteristic, a combined brightness/fire characteristic, or a scintillation characteristic, wherein the scintillation characteristic includes contributions from at least one pattern characteristic.

9. The method of claim 8, wherein scores are mapped to associated cut proportion ranges for the brightness characteristic and for the fire characteristic based upon predictive ray tracing calculations.

10. The method of claim 1, further comprising obtaining scores for a cut score component based upon an overweight characterization of a physical gemstone, and providing an overall cut grade for the physical gemstone that is determined by the worst of the scores obtained for the plurality of cut score components.

11. The method of claim 1, wherein the received cut proportions for the physical or virtual gemstone include one or more, or a combination of: crown angle, crown height, pavilion angle, pavilion depth, table size, total depth, star facet length, lower girdle facet length, girdle thickness, or culet size.

12. A method for providing scores for a plurality of cut score components for use in grading the cut of a physical or virtual gemstone having a set of cut proportions, comprising deriving theoretical scores for a plurality of cut score components corresponding to ranges of cut proportions;

setting empirically derived boundaries or thresholds in the ranges of cut proportions that correspond to the derived theoretical scores, wherein the boundaries or thresholds have been set by statistical analysis of observations; and outputting the cut grade reports for the gemstone.

13. The method of claim 12, wherein the theoretical scores and the corresponding ranges of cut proportions, and the empirically derived boundaries or thresholds in the ranges of cut proportions, are incorporated into prediction tables accessible for grading the cut of the physical or virtual gemstone.

14. The method of claim 12, wherein the gemstone is a virtual gemstone, and the step of deriving theoretical scores includes processing cut proportions with a number of appearance-based algorithms that have been derived from empirical observations.

* * * * *

US007571060C1

(12) INTER PARTES REEXAMINATION CERTIFICATE (675th)

United States Patent
Blodgett et al.

(10) Number: US 7,571,060 C1
(45) Certificate Issued: Aug. 21, 2013

(54) SYSTEM AND METHOD FOR GEMSTONE CUT GRADING

(75) Inventors: Troy Blodgett, Flagstaff, AZ (US); Ronald Geurts, Antwerp (BE); Al Gilbertson, Murrieta, CA (US); Barak Green, Oceanside, CA (US); T. Scott Hemphill, Lexington, MA (US); Tom Moses, Princeton Junction, NJ (US)

(73) Assignee: Gemological Institute of America, Inc., Carlsbad, CA (US)

Reexamination Request:
No. 95/001,542, Feb. 9, 2011

Reexamination Certificate for:

| | |
|---|---|
| Patent No.: | **7,571,060** |
| Issued: | **Aug. 4, 2009** |
| Appl. No.: | **10/952,386** |
| Filed: | **Sep. 27, 2004** |

(51) Int. Cl.

| | |
|---|---|
| ***G01B 5/30*** | (2006.01) |
| ***G01B 5/28*** | (2006.01) |
| ***G01N 21/00*** | (2006.01) |
| ***B24B 1/00*** | (2006.01) |
| ***B24B 7/19*** | (2006.01) |
| ***B24B 7/30*** | (2006.01) |

(52) U.S. Cl.
USPC ..... 702/35; 356/30; 451/28

(58) Field of Classification Search
None
See application file for complete search history.

(56) References Cited

To view the complete listing of prior art documents cited during the proceeding for Reexamination Control Number 95/001,542, please refer to the USPTO's public Patent Application Information Retrieval (PAIR) system under the Display References tab.

*Primary Examiner* — Robert Nasser

(57) ABSTRACT

A system for grading the cut of a diamond utilizes a number of appearance metrics to generate scores for a number of cut components that affect cut quality. These cut components include brightness, fire, scintillation, overweight, durability, polish, and symmetry. The cut grading system employs a cut grading algorithm that processes the individual scores obtained for the cut components to generate an overall cut grade for the diamond. The scoring methodology and the cut grading algorithm are designed to emulate actual observation grading such that the overall cut grade represents a fair indication of the cut quality of the diamond. In one practical embodiment, the cut grading system is fully automated and computer-implemented.

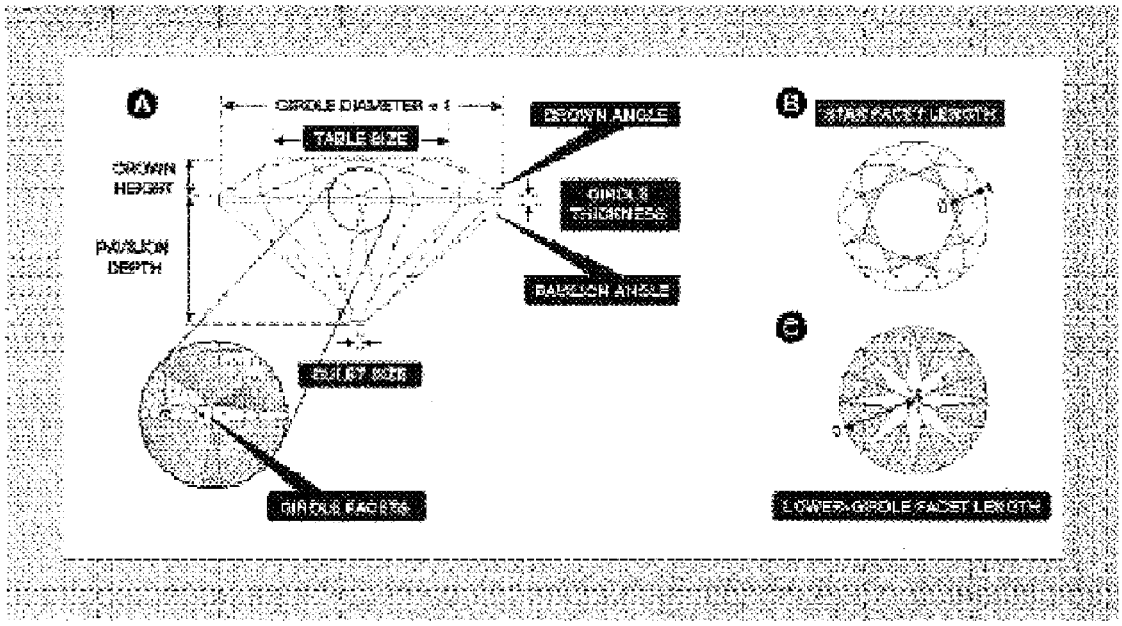

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-14 is confirmed.

New claims 15-18 are added and determined to be patentable.

*15. The method of claim 1, wherein the cut components comprise brightness, fire, pattern-related aspects of scintillation, weight ratio, durability, polish, and symmetry.*

*16. The method of claim 1, wherein the cut proportions comprise crown angle, crown height, pavilion angle, pavilion depth, table size, total depth, star facet size, lower girdle facet size, girdle thickness, culet size, and painting values.*

*17. The method of claim 1, wherein the range of possible scores for each of the plurality of cut score components is from 1 to 5.*

*18. The method of claim 1, wherein the observations comprise observations of actual diamonds by experienced diamond industry observers.*

* * * * *